US007288348B2

(12) United States Patent
Hayami et al.

(10) Patent No.: US 7,288,348 B2
(45) **Date of Patent: *Oct. 30, 2007**

(54) COLOR TONER

(75) Inventors: Kazuhiko Hayami, Ibaraki (JP); Tetsuya Ida, Shizuoka (JP); Nozomu Komatsu, Shizuoka (JP); Yasuhiro Ichikawa, Kanagawa (JP); Akira Hashimoto, Shizuoka (JP); Hirohide Tanikawa, Shizuoka (JP); Takakuni Kobori, Shizuoka (JP); Takayuki Itakura, Shizuoka (JP); Hiroyuki Fujikawa, Kanagawa (JP); Koh Ishigami, Shizuoka (JP); Nobuyoshi Sugahara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 297 days.

This patent is subject to a terminal disclaimer.

(21) Appl. No.: 10/936,565

(22) Filed: Sep. 9, 2004

(65) Prior Publication Data

US 2005/0079429 A1 Apr. 14, 2005

(30) Foreign Application Priority Data

Sep. 12, 2003 (JP) ..... 2003-321741
Sep. 12, 2003 (JP) ..... 2003-321743

(51) Int. Cl.
*G03G 9/08* (2006.01)

(52) U.S. Cl. ..... 430/45.1; 430/110.3; 430/110.4; 430/137.18; 430/137.2

(58) Field of Classification Search ..... 430/45, 430/110.3, 110.4, 137.18, 137.2, 45.1
See application file for complete search history.

(56) References Cited

U.S. PATENT DOCUMENTS

| | | | | |
|---|---|---|---|---|
| 6,033,817 | A | 3/2000 | Yusa et al. | 430/106.6 |
| 6,447,969 | B1 | 9/2002 | Ito et al. | 430/106.2 |
| 6,528,224 | B2 | 3/2003 | Ohno et al. | 430/108.8 |
| 6,596,452 | B2 | 7/2003 | Magome et al. | 430/106.2 |
| 6,635,398 | B1 | 10/2003 | Komoto et al. | 430/108.23 |
| 6,638,674 | B2 | 10/2003 | Komoto et al. | 430/106.1 |
| 2002/0055052 | A1 | 5/2002 | Komoto et al. | 430/106.1 |
| 2002/0115011 | A1 | 8/2002 | Komoto et al. | 430/125 |
| 2005/0191575 | A1* | 9/2005 | Sugiura et al. | 430/110.3 |

FOREIGN PATENT DOCUMENTS

| | | |
|---|---|---|
| JP | 7-181732 | 7/1995 |
| JP | 10-97095 | 4/1998 |
| JP | 10-232507 | 9/1998 |
| JP | 11-149174 | 6/1999 |
| JP | 2000-29241 | 1/2000 |

* cited by examiner

*Primary Examiner*—Mark A. Chapman
(74) *Attorney, Agent, or Firm*—Fitzpatrick, Cella, Harper & Scinto

(57) ABSTRACT

In a color toner having toner particles which have toner base particles containing a binder resin, a colorant and a wax, and inorganic fine particles, (i) in the toner base particles, particles having a circle-equivalent diameter of 3.00 μm or more as measured with a flow type particle image analyzer have an average circularity of from 0.920 or more to less than 0.950, (ii) in the particles having a circle-equivalent diameter of 3.00 μm or more in the toner base particles, particles having a circularity of 0.960 or more are in a number frequency cumulative value of 40% or less; and (iii) in the particles having a circle-equivalent diameter of 3.00 μm or more in the toner base particles, particles having a circularity of 0.920 or less are in a number frequency cumulative value of 30% or less. Also disclosed is a full-color image forming method making use of the toner.

13 Claims, 5 Drawing Sheets

COLOR TONER

BACKGROUND OF THE INVENTION

1. Field of the Invention

This invention relates to a toner used in image forming processes such as electrophotography, electrostatic recording, electrostatic printing and toner jet recording.

2. Related Background Art

In recent years, copying machines and printers are severely sought to be more compact, more light-weight, more high-speed and more high-reliability because of demands for energy saving, office space saving and so forth. As the result, hardware has come to be constituted of simple components in various aspects, and on the other hand the performance demanded of toners has come higher. That is, it is coming to pass that any superior hardware can not be provided unless improvements in performance of the toners can be achieved. In particular, what is required of the performance of toner is transfer performance. Improvement in this transfer performance of toner can bring advantages that toner consumption can be reduced, image quality can be made higher and a toner collection system can be made simple.

Accordingly, as one of methods for improving the transfer performance, it is recently prevalent to make the shape of toner base particles closely spherical. For example, it is known to use polymerization toner base particles produced by polymerization such as suspension polymerization or emulsion polymerization, or to make pulverization toner base particles spherical in a solution, to make them spherical by the action of hot air (Japanese Patent Application Laid-open No. 2000-029241) and to make them spherical by applying a mechanical impact force (Japanese Patent Application Laid-open No. H07-181732). These techniques are very effective means to improve transfer performance of toners, but each have various problems. In the case when the polymerization toner base particles are used, a release agent is enclosed in toner base particles, and hence the release agent may come out to toner particle surfaces with difficulty unless a pressure is appropriately applied to the toner at the time of fixing, resulting in a poor fixing performance. Also, in the case when the pulverization toner base particles are made spherical by applying a mechanical impact force, the release agent contained in toner base particles may more easily melt and come to toner particle surfaces because of heat, as they are made spherical more and more. This may adversely affect electrophotographic performance. That is, the release agent having melted and come to toner particle surfaces may make the toner have poor fluidity, or may make toner particles themselves and/or toner particles and carrier particles highly adherent to damage transfer performance. Accordingly, in making spherical the toner base particles to which the release agent has internally been added, it is important to select toner constituent materials capable of being made readily spherical, or to restrain any effect of heat history on toner base particles during the step of spherical treatment.

In order to manage such toner base particles to which the release agent has internally been added, having been improved in sphericity as stated above, it is proposed as disclosed in, e.g., Japanese Patent Application Laid-open No. H10-097095 to control average circularity and circularity distribution of toner base particles to control transfer performance and chargeability of a toner. However, in what is disclosed in Japanese Patent Application Laid-open No. H10-097095, a styrene-acrylic resin is used as a binder resin to be used in the toner, and no reference is made as to a color toner composed chiefly of a polyester.

In the step of making toner base particles spherical, in particular, in the step of making toner base particles spherical by applying a mechanical impact force, very small-sized fine powder (ultrafine powder) tends to form, and such ultrafine powder may re-agglomerate with the toner base particles having been made spherical. Hence, even if such toner base particles are subjected to the step of classification after the step of making spherical, it is difficult to remove this ultrafine powder from the toner base particles, and the ultrafine powder tends to be mixed into products. This ultrafine powder may be charged in excess in the step of development, and may adhere electrostatically to a sleeve, or a carrier in a two-component development system, to contaminate them to cause faulty charging of the toner fed afterwards.

Proposals to control the quantity of such ultrafine powder are also made in a large number. For example, as disclosed in Japanese Patent Applications Laid-open No. H10-232507 and H11-149174, a method is proposed in which the ultrafine powder is driven into toner particle surfaces by applying a mechanical impact after the step of classification. However, because of agitation at a developing zone and in a toner container throughout long-term running, the ultrafine powder driven into toner particle surfaces may come off to affect developing performance adversely.

On account of the foregoing, it has been sought to provide, in a color toner containing a release agent, a color toner having superior transfer performance, running performance and charge characteristics.

SUMMARY OF THE INVENTION

An object of the present invention is to provide a toner having solved the above problems. That is, an object of the present invention is to provide a color toner the particle shape and surface properties of toner base particles of which have been controlled to promise superior transfer performance, developing performance and running stability; and a full-color image forming method making use of the toner.

More specifically, the present invention provides a color toner comprising toner particles which comprise toner base particles containing a binder resin, a colorant and a wax, and inorganic fine particles, wherein;

(i) in the toner base particles, particles having a circle-equivalent diameter of 3.00 μm or more as measured with a flow type particle image analyzer have an average circularity of from 0.920 or more to less than 0.950;

(ii) in the particles having a circle-equivalent diameter of 3.00 μm or more in the toner base particles, particles having a circularity of 0.960 or more are in a number frequency cumulative value of 40% or less; and (iii) in the particles having a circle-equivalent diameter of 3.00 μm or more in the toner base particles, particles having a circularity of 0.920 or less are in a number frequency cumulative value of 30% or less.

The present invention also provides a full-color image forming method which forms an image by the use of at least a magenta toner, a yellow toner, a cyan toner and a black toner;

the toners each being a color toner comprising toner particles which comprise toner base particles containing a binder resin, a colorant and a wax, and inorganic fine particles, wherein;

(i) in the toner base particles, particles having a circle-equivalent diameter of 3.00 μm or more as measured with a flow type particle image analyzer have an average circularity of from 0.920 or more to less than 0.950;

(ii) in the particles having a circle-equivalent diameter of 3.00 μm or more in the toner base particles, particles having a circularity of 0.960 or more are in a number frequency cumulative value of 40% or less; and (iii) in the particles having a circle-equivalent diameter of 3.00 μm or more in the toner base particles, particles having a circularity of 0.920 or less are in a number frequency cumulative value of 30% or less.

DESCRIPTION OF THE PREFERRED EMBODIMENTS

Figure 1:
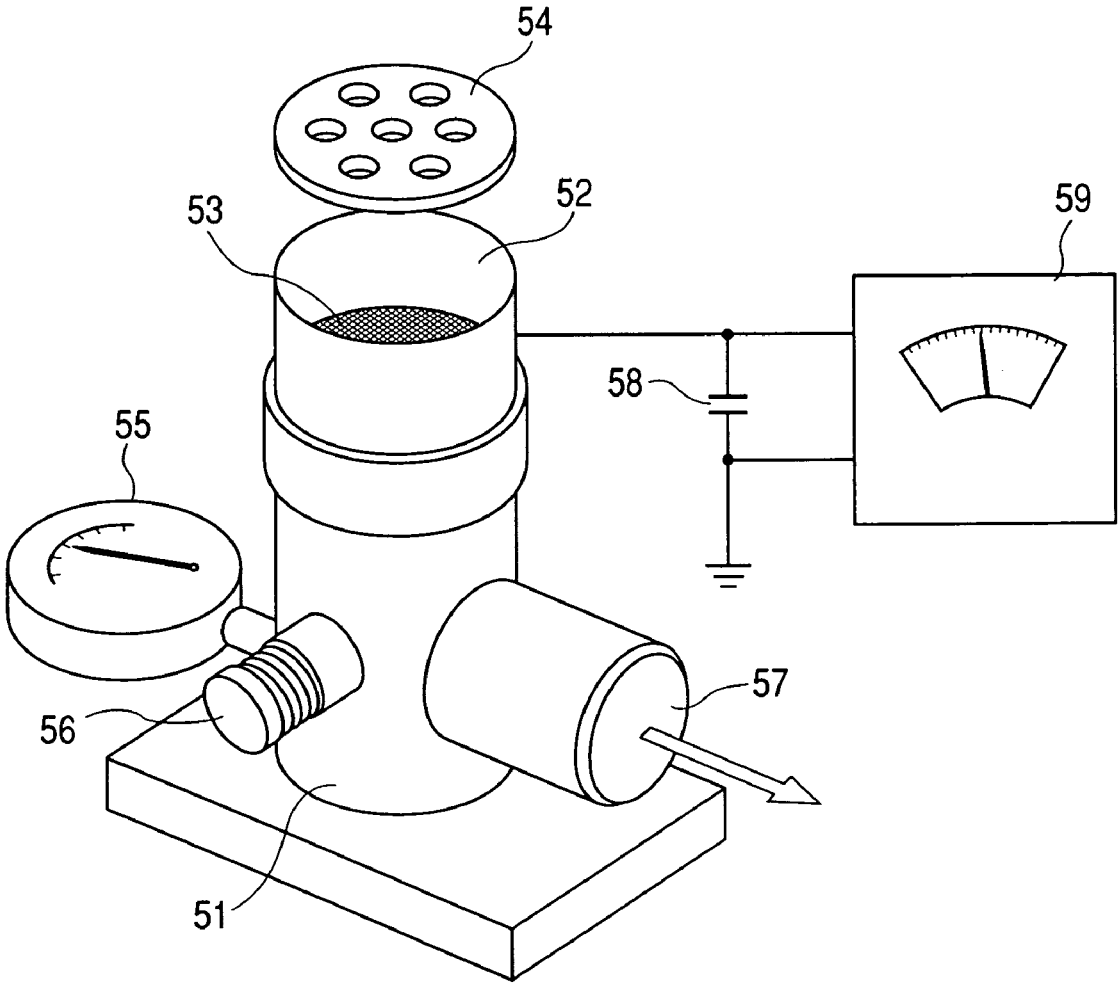
FIG. 1 illustrates a device for measuring triboelectric charge quantity.

According to the present invention, the use of a toner the particle shape and surface properties of toner base particles of which have been controlled can provide a color toner having superior transfer performance, developing performance and running stability. (The color toner is inclusive of a black toner.) The color toner can also have a sufficient fixable range, can achieve a sufficient developing performance even in continuous running, and also can readily promise sufficient cleaning performance. Hence, it can form images with high image quality.

The present invention is described below in detail by giving preferred embodiments.

The toner used in the present invention is described first.

In the present invention, the toner is a color toner comprising toner particles which comprise toner base particles containing a binder resin, a colorant and a wax, and inorganic fine particles, wherein;

(i) in the toner base particles, particles having a circle-equivalent diameter of 3.00 μm or more as measured with a flow type particle image analyzer have an average circularity of from 0.920 or more to less than 0.950;

(ii) in the particles having a circle-equivalent diameter of 3.00 μm or more in the toner base particles, particles having a circularity of 0.960 or more are in a number frequency cumulative value of 40% or less; and (iii) in the particles having a circle-equivalent diameter of 3.00 μm or more in the toner base particles, particles having a circularity of 0.920 or less are in a number frequency cumulative value of 30% or less.

In the toner base particles having a circle-equivalent diameter of 3.00 μm or more as measured with a flow type particle image analyzer, the particles may also preferably have an average circularity of from 0.925 or more to 0.940 or less. In the toner base particles having a circle-equivalent diameter of 3.00 μm or more, the particles having a circularity of 0.960 or more may preferably be in a number frequency cumulative value of 35% or less. In the toner base particles having a circle-equivalent diameter of 3.00 μm or more, the particles having a circularity of 0.920 or less may preferably be in a number frequency cumulative value of 25% or less.

Here, if the particles have an average circularity of less than 0.920 in the toner base particles having a circle-equivalent diameter of 3.00 μm or more as measured with a flow type particle image analyzer, the area of contact between toner particles themselves or between toner particles and carrier particles may be so large as to damage toner release, resulting in a poor transfer performance. If on the other hand the particles have an average circularity of 0.950 or more in the toner base particles having a circle-equivalent diameter of 3.00 μm or more as measured with a flow type particle image analyzer, the toner base particles have a closely spherical shape, so that, e.g., the toner may slip through the cleaning blade to cause faulty cleaning, or or it may be difficult for toner particles themselves, or toner particles and carrier particles, to be triboelectrically charged, resulting in unsharp images with much fog and many spots around line images.

If the particles having a circularity of 0.960 or more in the toner base particles having a circle-equivalent diameter of 3.00 μm or more are in a number frequency cumulative value of more than 40%, closely spherical toner particles are present in a large number to cause faulty cleaning. If on the other hand the particles having a circularity of 0.920 or less in the toner base particles having a circle-equivalent diameter of 3.00 μm or more are in a number frequency cumulative value of more than 30%, the toner may result in a poor transfer efficiency. Further, if the particles having a circularity of 0.960 or more in the toner base particles having a circle-equivalent diameter of 3.00 μm or more are in a number frequency cumulative value of more than 40% and also the particles having a circularity of 0.920 or less in the toner base particles having a circle-equivalent diameter of 3.00 μm or more are in a number frequency cumulative value of more than 30%, the toner base particles have a broad surface shape and the area of contact between the toner particles and the developer carrying member and/or photosensitive member may be so large that the charge of the toner tends to leak through the part coming into contact with the developer carrying member and/or photosensitive member, resulting in a lowering of charge quantity of the toner. Also, the area of contact between the toner particles and the photosensitive member may be so large that the toner particles have a large adhesion to the photosensitive member, making it difficult to achieve a sufficient transfer efficiency.

That is, inasmuch as the average circularity of particles in the toner base particles having a circle-equivalent diameter of 3.00 μm or more as measured with a flow type particle image analyzer is controlled within the range of from 0.920 or more to less than 0.950, the area of contact between toner particles themselves or between toner particles and carrier particles can be lessened to achieve an improvement in transfer performance and chargeability of the toner. Further, inasmuch as the number frequency cumulative value of the particles having a circularity of 0.960 or more in the toner base particles having a circle-equivalent diameter of 3.00 μm or more is controlled to be 40% or less and the number frequency cumulative value of the particles having a circularity of 0.920 or less in the toner base particles having a circle-equivalent diameter of 3.00 μm or more is controlled to be 30% or less, the toner can be improved in charge stability. Then, it has been discovered that the combination of the above physical properties makes small the area of contact between the toner particles and the photosensitive member to lower the adhesion of the toner particles to the photosensitive member that is caused by van der Waals force, bringing a further improvement in transfer efficiency.

In the present invention, it is also preferable that, in the toner base particles, particles having a circle-equivalent diameter of from 0.60 μm or more to less than 3.00 μm are present in a content A (% by number) which satisfies $0.1 \leqq A < 15.0$, more preferably $0.5 \leqq A < 12.0$, and still more preferably $1.0 \leqq A < 10.0$, with respect to all toner base particles. If the particles having a circle-equivalent diameter of from 0.60 μm or more to less than 3.00 μm are present in a content A of less than 0.1% by number with respect to all toner base particles, it means that substantially no fine powder is present. If on the other hand the particles having a circle-equivalent diameter of from 0.60 μm or more to less than 3.00 μm are present in a content A of 15.0% by number or more, the developing sleeve and/or the carrier in a two-component development system may be contaminated with the fine powder to tend to cause faulty charging of the toner.

In the present invention, it is further preferable that, in the toner base particles, particles having a circle-equivalent diameter of from 0.60 μm or more to less than 2.00 μm are present in a content B (% by number) and particles having a circle-equivalent diameter of from 2.00 μm or more to less than 3.00 μm are present in a content C (% by number) which B and C satisfy $0.5 < B/C < 4.0$ with respect to all toner base particles.

Toner particles having a circle-equivalent diameter of less than 3.00 μm tend to gather selectively around the part of a cleaning blade edge of a cleaning section. In particular, finer toner particles having a circle-equivalent diameter of less than 2.00 μm tend to gather to the blade edge. Toner particles having a circle-equivalent diameter of 3.00 μm forms a layer having a certain width along the cleaning blade edge, and can dam up and catch the waste toner and the in-machine arising paper dust or other dust at the cleaning blade edge to collect them without causing slip-through.

However, if the toner particles having a circle-equivalent diameter of less than 2.00 μm are in an excessive quantity, the toner particles themselves having a circle-equivalent diameter of less than 2.00 μm may slip through the cleaning blade edge, and the toner particles having slipped therethrough may damage the exposure and charging of the photosensitive member or may accelerate the disorder of latent images. Also, if toner particles having a circle-equivalent diameter of from 2.00 μm to less than 3.00 μm are in excess, the toner particles having a circle-equivalent diameter of less than 2.00 μm may insufficiently be fed to the blade edge to come into a depopulated condition to tend to cause chattering or turn-up of the blade. Inasmuch as the content B (% by number) of the particles having a circle-equivalent diameter of from 0.60 μm or more to less than 2.00 μm and the content C (% by number) of the particles having a circle-equivalent diameter of from 2.00 μm or more to less than 3.00 μm are controlled to the above proportion, this can keep faulty cleaning from occurring even in long-term service.

If the proportion of B/C is 0.5 or less, the proportion of the toner particles having a circle-equivalent diameter of from 2.00 μm to less than 3.00 μm is so large as to tend to cause faulty cleaning such as chattering or turn-up of the blade. If on the other hand the proportion of B/C is 4.0 or more, it means that the toner particles having a circle-equivalent diameter of less than 2.00 μm are in a large quantity, which tend to cause faulty cleaning such as slip through of the blade.

It is also preferable that, in the toner base particles, particles having a circle-equivalent diameter of from 0.60 μm or more to less than 2.00 μm are present in a content B (% by number) which satisfies $0.1 \leqq B < 10.0$, and more preferably $0.5 \leqq B < 8.0$. It is further preferable that, in the toner base particles, particles having a circle-equivalent diameter of from 2.00 μm or more to less than 3.00 μm are present in a content C (% by number) which satisfies $0.1 \leqq C < 5.0$, and more preferably $0.5 \leqq C < 3.0$.

If the B is 10.0% by number or more, the toner particles tend to slip through the cleaning blade for the above reasons. Also, if the C is 5.0% by number or more, it tends to cause chattering or turn-up of the cleaning blade.

In the present invention, it also preferable that the toner base particles have an average surface roughness of from 5.0 nm or more to less than 35.0 nm, more preferably from 10.0 nm or more to less than 30.0 nm, and still more preferably from 15.0 nm or more to less than 30.0 nm, as measured with a scanning probe microscope. Inasmuch as the toner base particles have an appropriate average surface roughness (smoothness), appropriate gaps are produced between toner particles, so that the toner can be improved in fluidity and can promise better developing performance. Especially in the toner base particles having the average circularity as specified in the present invention, the toner particles can be provided with more superior fluidity as having the above average surface roughness. If the toner base particles have an average surface roughness of less than 5.0 nm, the toner base particles may have too smooth surfaces to make the inorganic fine particles adhere thereto with ease, so that the fluidity of the toner tends to lower as a result of running, resulting in a lowering of image density in some cases. If the toner base particles have an average surface roughness of 35.0 nm or more, the toner base particles may have so largely uneven surfaces that the gaps between toner particles may come too large, and this tends to cause toner scatter.

The particle shape and surface properties of the the toner base particles in the present invention are also influenced by the selection of the binder resin which holds the greater part of the toner base particles. In particular, the controlling of the readiness to break of toner base particles in the step of pulverization of toner materials is greatly concerned in the average circularity of the toner base particles. Where a styrene-acrylic resin is used, it may readily be pulverized to have a toner particle surface shape which is uneven in a great extent, so that, in order to attain the particle shape and surface properties of the the toner base particles in the present invention, it is necessary to make surface shape control such as thermal treatment. Hence, this is undesirable in view of development. In this regard, where a resin having at least a polyester unit is used as the binder resin, though pulverizability may be inferior, the extent of unevenness can be kept small at the stage anterior to the step of classification because of circulation of toner base particles in a pulverization apparatus. Hence, this is preferable in order to attain the particle shape and surface properties of the the toner base particles in the present invention.

The binder resin used in the toner of the present invention may preferably be a resin selected from the group consisting of (a) a polyester resin, (b) a hybrid resin having a polyester unit and a vinyl polymer unit, (c) a mixture of the hybrid resin and a vinyl polymer, (d) a mixture of a polyester resin and a vinyl polymer, (e) a mixture of the hybrid resin and a polyester resin and (f) a mixture of the hybrid resin, a polyester resin and a vinyl polymer. The resin having a polyester unit, contained in the binder resin, may also preferably be in a proportion of 30% by weight or more, more preferably 40% by weight or more, and still more preferably 50% by weight or more, based on the total binder resin.

The "polyester unit" used in the present invention is meant to be a moiety derived from polyester, and polyester unit constituent components are specifically meant to be dihydric or higher alcohol monomer components and acid monomer components such as a dibasic or higher carboxylic acid, a dibasic or higher carboxylic anhydride and a dibasic or higher carboxylic ester. Also, the "vinyl polymer unit" is meant to be a moiety derived from a vinyl polymer, and a vinyl polymer unit constituent component is meant to be a monomer component having a vinyl group.

The toner of the present invention is characterized by using a resin having the polyester unit constituent components as a part of materials and having a moiety formed by condensation polymerization.

In the case when the polyester resin is used, an alcohol and a carboxylic acid, a carboxylic anhydride or a carboxylic ester may be used as raw-material monomers. Stated specifically, as a dihydric alcohol component, it may include, e.g., bisphenol-A alkylene oxide addition products such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher alcohol component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As a dibasic carboxylic acid monomer, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group or alkenyl group having 6 to 12 carbon atoms, or anhydrides thereof; and unsaturated dicarboxylic acids such as fumaric acid, maleic acid and citraconic acid, or anhydrides thereof.

As a tribasic or higher carboxylic acid monomer component, it may include polycarboxylic acids such as trimellitic acid, pyromellitic acid and benzophenonetetracarboxylic acid, or anhydrides thereof.

As other monomers, they may include polyhydric alcohols such as oxyalkylene ethers of novolak type phenol resin.

Of these, a polyester resin having as a diol component a bisphenol derivative represented by the following Formula (1) and as an acid component a dibasic or higher carboxylic acid or an acid anhydride thereof or a lower alkyl ester thereof (e.g., fumaric acid, maleic acid, maleic anhydride, phthalic acid, terephthalic acid, trimellitic acid or pyromellitic acid), and obtained by polycondensation of these components is particularly preferred because it affords good charge characteristics as the color toner. Formula (1)

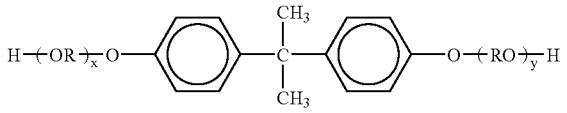

wherein R represents an ethylene group or a propylene group, x and y are each an integer of 1 or more, and an average value of x+y is 2 to 10.

Further, in the case when the binder resin having a hybrid resin component is used, it brings much better improvements in wax dispersibility, low-temperature fixing performance and anti-offset properties. The "hybrid resin component" referred to in the present invention is meant to be a resin formed by chemical linkage of the vinyl polymer unit and the polyester unit. Stated specifically, it is a resin formed by ester interchange reaction of a polyester unit with a vinyl polymer unit made up by polymerizing a monomer having a carboxylate group such as acrylate or methacrylate, which may preferably form a graft copolymer (or block copolymer) composed of the vinyl polymer unit as the backbone polymer and the polyester unit as the branch polymer.

As a vinyl monomer for forming the vinyl polymer unit or vinyl polymer in the present invention, it may include the following: Styrene; styrene derivatives such as o-methylstyrene, m-methylstyrene, p-methylstyrene, α-methylstyrene, p-phenylstyrene, p-ethylstyrenee, 2,4-dimethylstyrene, p-n-butylstyrene, p-tert-butylstyrene, p-n-hexystyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include monomers having carboxyl groups as exemplified by unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half esters, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, alkenyladipic acids, acid anhydrides of these and monoesters of these.

It may still further include monomers having hydroxyl groups as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl)styrene.

The vinyl polymer or vinyl polymer unit in the present invention may have a cross-linked structure, cross-linked with a cross-linking agent having at least two vinyl groups. The cross-linking agent used in such a case may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moieties have each been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moieties have each been replaced with methacrylate; diacrylate compounds linked with a chain containing an aromatic group and an ether linkage, as exemplified by polyoxythylene(2)-2,2-bis(4-hydroxyphenyl)propane diacrylate, polyoxythylene(4)-2,2-bis(4-hydroxyphenyl)propane diacrylate, and the above compounds whose acrylate moieties have each been replaced with methacrylate.

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moieties have each been replaced with methacrylate; triallylcyanurate, and triallyltrimellitate.

It is preferable in the present invention that the vinyl polymer or vinyl polymer unit and/or the polyester resin or polyester unit is/are incorporated with a monomer component capable of reacting with both the resin components. Among monomers constituting the polyester resin or polyester unit, a monomer capable of reacting with the vinyl polymer or vinyl polymer unit may include, e.g., unsaturated dicarboxylic acids such as fumaric acid, maleic acid, citraconic acid and itaconic acid, or anhydrides thereof. Among monomers constituting the vinyl polymer or vinyl polymer unit, a monomer capable of reacting with the polyester resin or polyester unit may include monomers having a carboxyl group or a hydroxyl group, and acrylates or methacrylates.

As a method for obtaining the reaction product of the vinyl polymer with the polyester resin, preferred is a method in which, in the state a polymer or resin containing the above monomers capable of respectively reacting with the vinyl polymer and the polyester resin are present, polymerization reaction for any one or both of the polymers or resins is carried out to obtain it.

As a polymerization initiator used when the vinyl polymer or vinyl polymer unit in the present invention is used, it may include, e.g., azo compounds such as 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexanecarbonitrile), 2-(carbamoylazo)isobutyronitrile, 2,2'-azobis-(2,4,4-trimethylpentane), 2-phenylazo-2,4-dimethyl-4-methoxyvaleronitrile and 2,2'-azobis-(2-methyl-propane); ketone peroxides such as methyl ethyl ketone peroxide, acetylacetone peroxide and cylcohexanone peroxide; and other types such as 2,2-bis(t-butylperoxy) butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxylbenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate and di-t-butyl peroxyazelate.

As methods by which the hybrid resin used in the full-color toner of the present invention can be produced may include, e.g., the following production methods shown in (1) to (6).

(1) A method of blending a vinyl polymer and a polyester resin after they have independently been produced. These may be blended by dissolving and swelling them in an organic solvent (e.g., xylene), followed by evaporation of the organic solvent to produce the hybrid resin. Incidentally, as the hybrid resin component, the hybrid resin having a polyester unit and a vinyl polymer unit can be obtained which is synthesized by first separately producing a vinyl polymer and a polyester resin, and thereafter dissolving and swelling them in a small amount of organic solvent, followed by addition of an esterifying catalyst and an alcohol and then heating to effect ester exchange reaction.

(2) A method of first producing a vinyl polymer and thereafter producing a polyester resin in the presence of the vinyl polymer, which are allowed to react to produce the hybrid resin component having a polyester unit and a vinyl polymer unit. The hybrid resin component is produced by allowing the vinyl polymer (a vinyl monomer may optionally be added) to react with a polyester monomer (such as an alcohol or a carboxylic acid) and/or a polyester resin. In this case as well, any organic solvent may appropriately be used.

(3) A method of first producing a polyester resin and thereafter producing a vinyl polymer in the presence of the polyester unit, which are allowed to react to produce the hybrid resin component having a polyester unit and a vinyl polymer unit. The hybrid resin component is produced by allowing the polyester resin (a polyester monomer may optionally be added) to react with a vinyl monomer and/or the vinyl polymer.

(4) A vinyl polymer and a polyester resin are first produced and thereafter a vinyl monomer and/or a polyester monomer (such as an alcohol or a carboxylic acid) is/are added to produce the hybrid resin component. In this case as well, any organic solvent may appropriately be used.

(5) The hybrid resin component having a polyester unit and a vinyl polymer unit is first produced and thereafter a vinyl monomer and/or a polyester monomer (such as an alcohol or a carboxylic acid) is/are added to effect addition polymerization and/or polycondensation reaction to produce a vinyl polymer and/or a polyester resin, or further produce a hybrid resin component. In this case, as the hybrid resin component having a polyester unit and a vinyl polymer unit, any of the hybrid resins produced by the above methods (2) to (4) may be used, or optionally a hybrid resin produced by any conventional method may also be used. Also, any organic solvent may appropriately be used.

(6) A vinyl monomer and a polyester monomer (such as an alcohol or a carboxylic acid) are mixed to effect addition polymerization and polycondensation reaction continuously to produce a vinyl polymer, a polyester resin and the hybrid resin component having a polyester unit and a vinyl polymer unit. Also, any organic solvent may appropriately be used.

In the above production processes (1) to (6), a plurality of polymer units having different molecular weights and different degrees of cross-linking may be used as the vinyl polymer unit and/or the polyester unit.

In the present invention, the vinyl polymer or vinyl polymer unit is meant to be a vinyl homopolymer or a vinyl copolymer, or a vinyl homopolymer unit or a vinyl copolymer unit.

The binder resin used in the toner of the present invention may preferably have a glass transition temperature (Tg) of from 40° C. to 90° C. and a softening temperature (Tm) of from 80° C. to 150° C., which is preferable in order to achieve all the storage stability, the dispersibility of colorant and the fixing performance.

The binder resin may also preferably have an acid value of from 2 mg·KOH/g or more to less than 50 mg·KOH/g. If the binder resin has an acid value of less than 2 mg·KOH/g, the superiority in negative chargeability the polyester has by nature can not sufficiently be obtained, resulting in inferior fixing performance and anti-offset properties in some cases. If on the other hand it has an acid value of 50 mg·KOH/g or more, a poor water resistance in a high-temperature and high-humidity environment may result, which may lead to a factor that causes problems such as fog and toner scatter.

Then, as the wax (release agent) used in the present invention, it may include the following: Aliphatic hydrocarbon waxes such as low-molecular weight polyethylene, low-molecular weight polypropylene, low-molecular weight olefin compolymer, microcrystalline wax, Fischer-Tropsch wax and paraffin wax; oxides of aliphatic hydrocarbon waxes, such as polyethylene oxide wax, or block copolymers of these; ester waxes such as behenyl behenate wax and stearyl stearate wax; waxes composed chiefly of a fatty ester, such as carnauba wax and montanate wax, and those obtained by subjecting part or the whole of fatty esters to deoxidizing treatment, such as dioxidized carnauba wax. It may further include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylene bis(stearic acid amide), ethylene bis(capric acid amide), ethylene bis(lauric acid amide) and hexamethylene bis(stearic acid amide); unsaturated fatty acid amides such as ethylene bis(oleic acid amide), hexamethylene bis(oleic acid amide), N,N'-dioleyladipic acid amide and N,N'-dioleylsebasic acid amide; aromatic bisamides such as m-xylene bisstearic acid amide and N,N'-distearylisophthalic acid amide; fatty acid metal salts (those commonly called metal soap) such as calcium stearate, calcium laurate, zinc stearate and magnesium stearate; waxes grafted using vinyl monomers such as styrene and acrylic acid, to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

The toner of the present invention may preferably have, in the endothermic curve measured by differential thermal analysis (or differential scanning calorimetry DSC), one, or a plurality of, endothermic peak(s) in the range of from 30° C. to 200° C. and a maximum peak temperature of the endothermic peak(s) in the range of from 60° C. to 110° C., and more preferably in the range of from 70° C. to 100° C. If the peak temperature of the maximum endothermic peak is less than 60° C., the toner may have poor anti-blocking properties. If on the other hand the peak temperature of the maximum endothermic peak is more than 110° C., the toner may have a low fixing performance. The wax (release agent) may preferably be in an amount of from 0.5 to 10 parts by weight, and more preferably from 2 to 8 parts by weight, based on 100 parts by weight of the binder resin.

The toner of the present invention may preferably contain one or more kinds of release agent(s). Further, in the toner of the present invention, from the viewpoint of the achievement of both low-temperature fixing performance and anti-blocking properties, the release agent may be a hydrocarbon wax, and more preferably paraffin wax.

The toner of the present invention may also preferably have a light transmittance (%) in the range of from 10% to 80% which is of the light of 600 nm in wavelength with respect to a liquid dispersion prepared by dispersing the toner in an aqueous solution of 45% by volume of methanol, and more preferably in the range of from 15% to 70%.

The quantity of a release agent in the vicinity of toner particle surfaces can be known, as a simple and high-precision method, by measuring the light transmittance of the light of 600 nm in wavelength with respect to a liquid dispersion prepared by dispersing the toner in an aqueous solution of 45% by volume of methanol, whereby the whole toner base particles can be revealed. This measuring method can accurately find the content of the release agent present in the whole toner, by first dispersing the toner forcedly in a mixed solvent to make it easy to characterize the content of the release agent at every particle-by-particle surface of the toner, and then measuring the light transmittance after lapse of a certain time. That is, when the release agent, which is hydrophobic, is present at the toner particle surfaces in a large quantity, the toner can not easily be dispersed and may come agglomerated and settle, and hence the light transmittance comes to a high value. When on the other hand the release agent is present at the toner particle surfaces in a small quantity the binder resin, which is hydrophilic, is present in a large quantity, where the toner is uniformly dispersed, so that the light transmittance comes to a value of as small as 10%. That is, it follows that the state of presence of the release agent component in the toner is indicated by the light transmittance (%) in an aqueous 45% by volume methanol solution of the toner. The controlling of it enables production of a toner which has achieved a broader fixable range, also can prevent the release agent from coming off toner particles, and can be free of any contamination on developing members even in long-term service.

If the toner has a light transmittance of less than 10%, the release agent is in so small a quantity at toner particle surfaces that the release effect can not easily be brought out at the time of fixing, and hence the low-temperature fixing can not be performed which is desired from the viewpoint of energy saving, and also a load which requires a considerable pressure is necessary for the setup of fixing. If on the other hand it has a light transmittance of more than 80%, the release agent is in so large a quantity at toner particle surfaces that the release agent may contaminate charge-providing members. For example, it may melt-adhere to the developing sleeve to make the sleeve have a high resistance to cause a lowering of the effect of actual development bias applied at the time of development, and furthermore cause a lowering of image density.

Then, the colorant to be incorporated in the toner base particles of the toner of the present invention, any known dye and/or pigment may be used. As pigments for magenta toner, they may include azo pigments such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 52, 53, 54, 55, 57, 58, 60, 63, 64, 68, 112, 114, 119, 136, 147, 148, 150, 164, 170, 238; condensed polycyclic pigments such as C.I. Pigment Red 88, 122, 123, 202, 206, 207, 209, C.I. Pigment Violet 19, and C.I. Vat Red 23, 29, 35; and lake pigments such as C.I. Pigment Red 81, 83, and C.I. Vat Red 1, 2. Of these pigments, azo pigments are preferred.

Such a pigment may be used alone. In view of image quality of full-color images, it is more preferable to use a dye and a pigment in combination to improve their sharpness. As dyes for magenta toner, they may include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

As other coloring pigments, as pigments for cyan toner, they may include C.I. Pigment Blue 2, 3, 15, 16, 17, C.I. Vat Blue 6, and C.I. Acid Blue 45, or copper phthalocyanine pigments whose phthalocyanine skeleton has been substituted with 1 to 5 phthalimide methyl group(s).

As pigments for yellow toner, they may include azo pigments such as C.I. Pigment Yellow 1, 2, 3, 5, 6, 12, 13, 14, 17, 49, 65, 73, 74, 128, 180, and condensed polycyclic pigments such as C.I. Pigment Yellow 110, 139, 147, 173, 185. Of these pigments, azo pigments are preferred.

As black colorants, usable are carbon black, and colorants toned in black by using the yellow, magenta and cyan colorants shown above.

The colorant may be used in an amount of from 0.1 to 20 parts by weight, and more preferably from 0.5 to 15 parts by weight, based on 100 parts by weight of the binder resin.

To the toner base particles, a charge control agent may also optionally be added. Any known agent may be used as the charge control agent, which may include aromatic carboxylic acid derivatives and aromatic carboxylic acid metal compounds. For example, as metals of the aromatic carboxylic acid metal compounds, divalent or more metal atoms are preferred. As divalent metal atoms, they may include $Mg^{2+}$, $Ca^{2+}$, $Sr^{2+}$, $Pb^{2+}$, $Fe^{2+}$, $Co^{2+}$, $Ni^{2+}$, $Zn^{2}$+ and $Cu^{2+}$. In particular, $Zn^{2+}$, $Ca^{2+}$, $Mg^{2+}$ and $Sr^{2+}$ are preferred. As trivalent or more atoms, they may include $Al^{3+}$, $Cr^{3+}$, $Fe^{3+}$, $Ni^{3+}$, $Ti^{4+}$, $Zr^{4}$+ and $Si^{3+}$. Of these metals, preferred are $Al^{3}$+ and $Cr^{3+}$, and particularly preferred is $Al^{3+}$. In the present invention, an aluminum compound of 3,5-di-tert-butylsalicylic acid is particularly preferred as the charge control agent.

The charge control agent may be used in an amount of from 0.1 to 10% by weight based on the weight of the toner. Such use is preferable because there can be less initial-stage variations in charge quantity of the toner, the necessary absolute charge quantity can be obtained with ease at the time of development, and consequently any lowering of image quality such as fog and image density decrease does not occur.

The toner of the present invention further has inorganic fine particles together with the toner base particles, in order to improve image quality and improve storage stability in a high-temperature environment. Such inorganic fine particles may preferably be inorganic fine particles of silica, titanium oxide and aluminum oxide. In particular, the inorganic fine particles may particularly preferably be fine titanium oxide particles especially in view of advantages that the inorganic fine particles can be kept from deteriorating at the time of development, e.g., in respect of the surface shape of toner base particles, the inorganic fine particles can be kept from being buried in the toner base particles or can be kept from coming off the toner base particles, and that the fluidity and charge stability of the toner can be made stable.

The inorganic fine particles may preferably be those having been made hydrophobic with a hydrophobic-treating agent such as a silane compound, a silicone oil or a mixture of these. The hydrophobic-treating agent may include coupling agents such as a silane compound, a titanate coupling agent, an aluminum coupling agent and a zircoaluminate coupling agent.

Stated specifically, the silane compound for example may preferably be a compound represented by the following formula:

$$R_mSiY_n$$

wherein R represents an alkoxyl group; m represents an integer of 1 to 3; Y represents an alkyl group, a vinyl group, a phenyl group, a methacrylic group, an amino group, an epoxy group, a mercapto group or a derivative of any of these; and n represents an integer of 1 to 3. Such a compound may include, e.g., vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane.

In the hydrophobic treatment, the silane compound may preferably be used in an amount of from 1 to 60 parts by weight, and more preferably from 3 to 50 parts by weight, based on 100 parts by weight of the inorganic fine particles.

What is particularly preferred in the present invention is a compound represented by the following general formula, which is an alkylalkoxysilane coupling agent:

$$C_nH_{2n+1}—Si—(OC_mH_{2m+1})_3$$

wherein n represents an integer of 4 to 12, and m represents an integer of 1 to 3.

In the above alkylalkoxysilane coupling agent, if n is smaller than 4, though hydrophobic treatment may be made with ease, a little low hydrophobicity may result. if n is larger than 12, though hydrophobicity can be sufficient, inorganic fine particles may greatly coalesce one another to tend to have a low fluidity-providing ability. If m is larger than 3, the alkylalkoxysilane coupling agent may have a low reactivity to make it hard for the inorganic fine particles to be made well hydrophobic. More preferably, in the alkylalkoxysilane coupling agent, n may be from 4 to 8, and m may be 1 or 2.

In the treatment with the alkylalkoxysilane coupling agent, it may be used in an amount of from 1 to 60 parts by weight, and preferably from 3 to 50 parts by weight, based on 100 parts by weight of the inorganic fine particles.

The hydrophobic treatment may be made using one kind of hydrophobic-treating agent alone, or using two or more kinds of hydrophobic-treating agents. For example, the hydrophobic treatment may be made using one kind of hydrophobic-treating agent alone or using two kinds of hydrophobic-treating agents simultaneously, or the hydrophobic treatment may be made first using one hydrophobic-treating agent and thereafter further using another hydrophobic-treating agent.

The inorganic fine particles may preferably be added in an amount of from 0.01 to 5 parts by weight, and preferably from 0.05 to 3 parts by weight, based on 100 parts by weight of the toner base particles.

The toner of the present invention may be used in either of one-component developers and two-component developers, without any particular limitations thereto. In the case when it is used in the two-component developers, the toner is used in combination with a carrier. As the carrier, usable are particles of metals such as iron, nickel, copper, zinc, cobalt, manganese, chromium and rare earth elements, which may be surface-oxidized or unoxidized, and alloys or oxides of any of these, and ferrite.

In particular, magnetic ferrite particles composed of Mn—Mg—Fe three elements, formed of manganese, magnesium and iron as chief components, are preferred as carrier particles. The magnetic ferrite particles may preferably be coated with a resin. The resin may include silicone resins, polyester resins, styrene resins, acrylic resins, polyamide resins, polyvinyl butyral resins and aminoacrylate resins, and silicone resins are particularly preferred. In particular, nitrogen-containing silicone resins, or modified silicone resins formed by the reaction of a nitrogen-containing silane coupling agent with a silicone resin are preferred in view of the providing of the toner of the present invention with negative triboelectric charges, the environmental stability, and the restraint of contamination of carrier particle surfaces.

As coating methods, conventionally known methods are applicable, such as a method in which a coating fluid prepared by dissolving or suspending a coating material such as a resin in a solvent is made to adhere to the surfaces of magnetic carrier core particles, and a method in which magnetic carrier core particles and a coating material are mixed in the form of powder.

The magnetic carrier may have an average particle diameter of from 15 μm to 60 μm (more preferably from 25 μm to 50 μm). This is preferable in view of its relation with weight-average particle diameter of the toner. As a method for preparing the magnetic carrier so as to have the above average particle diameter and a specific particle size distribution, it can be done, e.g., by classification making use of a sieve. In particular, in order to carry out classification in a good precision, it is preferable to carry out sieving repeatedly several times, using a sieve having a suitable mesh. It is also an effective means to use a sieve the shape of mesh openings of which has been controlled by plating or the like.

In the case when a two-component developer is prepared, the toner and the carrier may be blended in such a proportion that the toner concentration in the developer is from 2 to 15% by weight, and preferably from 4 to 13% by weight, where good results can be obtained in usual cases. If the toner concentration is less than 2%, image density tends to lower. It it is more than 15% by weight, fog and in-machine toner scatter tend to occur greatly.

The toner of the present invention may also preferably be a non-magnetic toner.

The toner of the present invention may also preferably be used in a full-color image forming method which forms an image making use of at least a magenta toner, a yellow toner, a cyan toner and a black toner. Here, it is more preferable that all the toners used in the full-color image forming method are each the toner of the present invention. Also, the use of the toner of the present invention is preferable also in an image forming method in which toner images are transferred to recording materials via an intermediate transfer member, because good full-color images can be obtained which have faithfully reproduced an original.

A procedure for producing the toner is described below.

The toner base particles in the present invention may preferably be toner base particles obtained through at least:

a kneading step of melt-kneading a mixture containing a binder resin and a colorant, to obtain a kneaded product;

a cooling step of cooling the kneaded product obtained;

a crushing step of crushing the kneaded product cooled, to obtain a crushed product;

a pulverization step of finely pulverizing the resultant crushed product by the use of an air pulverizing means to form a finely pulverized product;

a classification step of classifying the resultant finely pulverized product by the use of a multi-division classifying means that utilizes the Coanda effect, to obtain a median powder; and a surface modification step of subjecting the resultant median powder to surface modification of particles by the use of a surface modifying apparatus.

First, in the kneading step, at least the binder resin and the colorant are weighed and compounded in stated quantities, mixed and melt-kneaded to melt the binder resin and obtain a keneaded product having the colorant dispersed in the binder risen. As examples of a mixer therefor, it includes Doublecon Mixer, a V-type mixer, a drum type mixer, Super mixer, Henschel mixer and Nauta mixer. In that kneading step, batch type kneaders such as a pressure kneader and Banbury mixer, or continuous-type kneaders may be used, for example. In recent years, single-screw or twin-screw extruders are prevailing because of an advantage of enabling continuous production. For example, commonly used are a KTK-type twin-screw extruder manufactured by Kobe Steel, Ltd., a TEM-type twin-screw extruder manufactured by Toshiba Machine Co., Ltd., a twin-screw extruder manufactured by KCK Co., and a co-kneader manufactured by Coperion Buss Ag. The kneaded product obtained is further rolled out by means of a twin-roll mill, followed by cooling through a cooling step where the kneaded product is cooled.

Then, in general, the kneaded product thus obtained is pulverized in a pulverization step into a product having the desired particle diameter. In the pulverization step, it is first crushed by means of a grinding machine such as a crusher, a hammer mill or a feather mill, and is further pulverized by means of Criptron system (manufactured by Kawasaki Heavy Industries, Ltd.) or Super rotor (manufactured by Nisshin Engineering Inc.) Thereafter, the pulverized product obtained is optionally classified using a classifier such as Elbow Jet (manufactured by Nittetsu Mining Co., Ltd.), which is of an inertial classification system, or Turboplex (manufactured by Hosokawa Micron Corporation), which is of a centrifugal classification system, to obtain a classified product (toner base particles) with a weight-average particle diameter of from 3 μm to 11 μm. This classified product may optionally be put to a surface modification step to carry out spherical treatment (circularity control) and smoothing treatment (surface roughness control) by means of, e.g., a hybridization system manufactured by Nara Machinery Co., Ltd. or a mechanofusion system manufactured by Hosokawa Micron Corporation.

Figure 4:
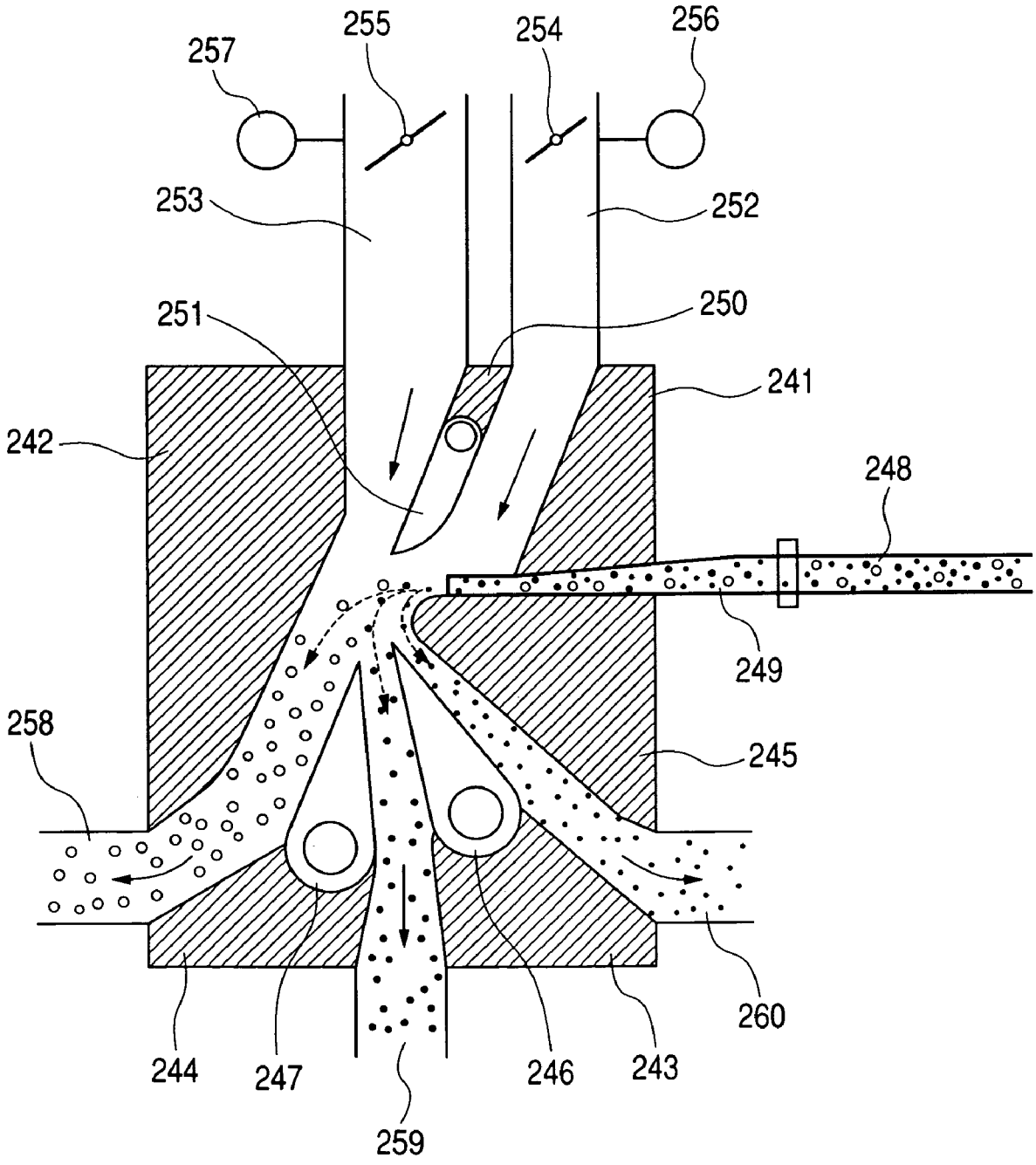
FIG. 4 is a schematic sectional view of a multi-division classifying means used in the step of classification in the present invention.

In the present invention, in order to obtain the toner of the present invention, the kneaded product having been cooled is first crushed to obtain a crushed product. The crushed product obtained is repeatedly pulverized several times by an air pulverizing means such as an air-jet pulverizer to form a finely pulverized product. The finely pulverized product obtained is classified by the use of a multi-division classifying means that utilizes the Coanda effect, such as Elbow Jet classifier shown in FIG. 4, to obtain a median powder from among coarse powder, median powder and fine powder. In FIG. 4, reference numerals 241 and 242 denote sidewalls; 243 and 244, classifying edge blocks; 245, Coanda block; 246 and 247, classifying edges; 248 and 249, material feed pipes; 250, a classification chamber upper wall; 251, an air in-take edge; 252 and 253; air in-take pipes; 255, an air feed control means; 256 and 257, static-pressure gauges; and 258, 259 and 260, discharge outlets.

Figure 2:
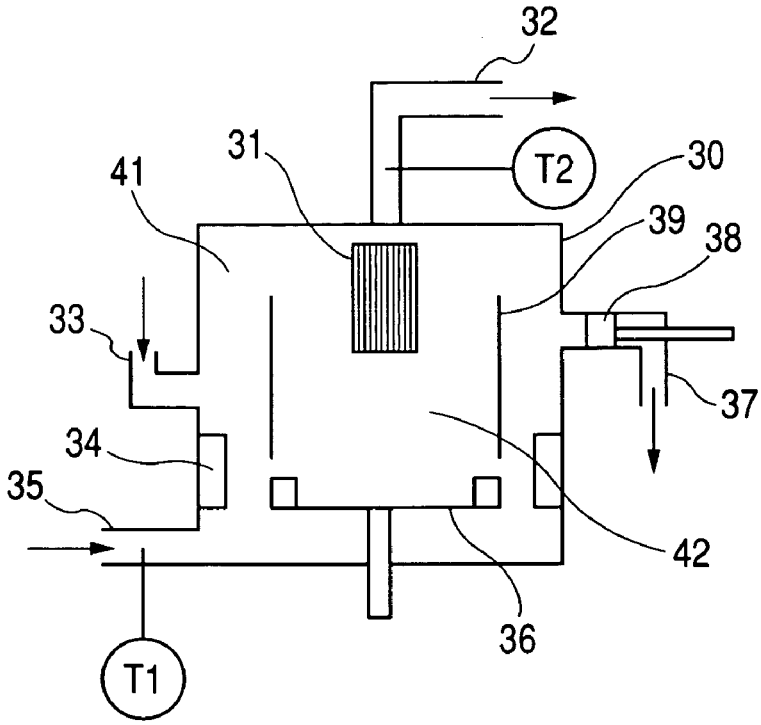
FIG. 2 is a schematic sectional view of an example of a surface modifying apparatus used in the step of surface modification in the present invention.
Figure 3:
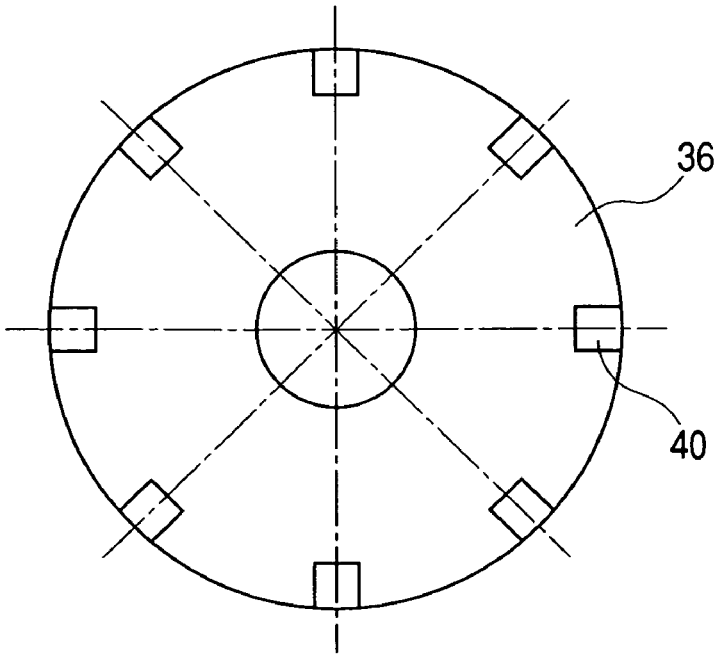
FIG. 3 is a schematic view showing an example of a top plan view of a dispersing rotor shown in FIG. 2.

The median powder obtained may preferably be subjected to surface modification of particles by means of a surface modifying apparatus shown in FIGS. 2 and 3, which simultaneously carries out classification treatment and surface modification treatment making use of a mechanical impact force, to obtain the toner base particles with a weight-average particle diameter of from 3 μm to 11 μm.

Further, as a method for external addition treatment of external additives such as the inorganic fine particles, the classified toner base particles and known various external additives may be formulated in stated quantities, and then agitated and mixed by means of a high-speed agitator which imparts a shear force to powder, such as Henschel mixer or Super mixer, to obtain the toner.

The surface modifying apparatus shown in FIG. 2, used preferably in the present invention, is described here in detail. As shown in FIG. 2, the surface modifying apparatus is constituted of a casing 30; a jacket (not shown) through which cooling water or an anti-freeze can be passed; a surface modification means dispersing rotor 36 which is a disklike rotating member rotatable at a high speed, provided in the casing 30 and attached to the center rotational shaft, and having on the top surface a plurality of rectangular disks or cylindrical pins 40; liners 34 disposed on the outer periphery of the dispersing rotor 36 at intervals kept constant and provided with a large number of grooves at the surfaces (incidentally, the grooves at the liner surfaces may be not provided); a classifying rotor 31 which is a means for classifying a surface-modified material into those with stated particle diameters; a cold air inlet 35 for introducing cold air therethrough; a material feed opening 33 for introducing therethrough the material to be treated; a discharge valve 38 provided open-close operably so that surface modification time can freely be controlled; a powder discharge opening 37 for discharging therethrough the powder having been treated; and also a cylindrical guide ring 39 which is a means by which the space defined by the classification means classifying rotor 31, the surface modification means dispersing rotor 36 and the liners 34 is partitioned into a first space 41 through which the material passes before it is introduced into the classification means and a second space 42 through which the particles from which fine powder has been removed by classification by the classification means are introduced into the surface modification means. A gap formed between the dispersing rotor 36 and the liners 34 is a surface modification zone, and the part holding the classifying rotor 31 and its surroundings is a classification zone.

In the surface modifying apparatus constituted as described above, the finely pulverized product is introduced through the material feed opening 33 in the state the discharge valve 38 is closed, whereupon the finely pulverized product introduced is first sucked by a blower (not shown), and then classified by the classifying rotor 31. In that classification, the classified, fine powder with particle diameter smaller than the stated particle diameter is continuously discharged and removed out of the apparatus, and coarse powder with particle diameter larger than the stated particle diameter rides on circulating flows generated by the dispersing rotor 36, along the inner periphery of the guide ring 39 (in the second space 42) by the aid of centrifugal force, and is guided to the surface modification zone. The material guided to the surface modification zone undergoes mechanical impact force between the dispersing rotor 36 and the liners 34, and is treated by surface modification. The surface-modified particles, having been subjected to surface modification, ride on the cold air passing through the interior of the apparatus, and is guided to the classification zone along the outer periphery of the guide ring 39 (in the first space 41), where fine powder is again discharged out of the apparatus by the action of the classifying rotor 31, and coarse powder, riding on the circulating flows, is again returned to the surface modification zone to undergo surface modification action repeatedly. After lapse of a certain time, the discharge valve 38 is opened to collect the surface-modified particles through the discharge opening 37.

As a result of studies made by the present inventors, it has been found that the time by which the discharge valve is opened (i.e., cycle time) and the number of revolutions of the dispersing rotor are important in controlling the circularity and surface roughness of the toner base particles. In order to make sphericity higher and make surface roughness lower, it is effective to make the cycle time longer or make the peripheral speed of the dispersing rotor higher. Also, in order to make the surface roughness higher, it is effective to conversely make the cycle time shorter or make the peripheral speed lower. In particular, since the particles can not efficiently be made spherical unless especially the peripheral speed of the dispersing rotor is a certain speed or more, the cycle time must be set longer to carry out spherical treatment, where the peripheral speed has been found effective when it is $1.2\times10^5$ mm/sec or more, and the cycle time, from 15 to 60 seconds.

Measuring methods in the present invention are described below.

(1) Measurement of Circle-Equivalent Diameter and Average Circularity of Toner Base Particles:

The circle-equivalent diameter and average circularity of the toner base particles are measured with a flow type particle image analyzer "FPIA-2100 Model" (manufactured by Sysmex Corporation), and is calculated using the following expressions.

$$\text{Circle-equivalent diameter}=(\text{particle projected area}/\pi)^{1/2}\times 2$$

$$\text{Circularity}=\frac{\text{Circumferential length of a circle with the same area as particle projected area}}{\text{Circumferential length of particle projected image}}$$

Here, the "particle projected area" is meant to be the area of a binary-coded toner particle image, and the "circumferential length of particle projected image" is defined to be the length of a contour line formed by connecting edge points of the toner particle image. In the measurement, used is the circumferential length of a particle image in image processing at an image processing resolution of 512×512 (a pixel of 0.3 μm×0.3 μm).

The circularity referred to in the present invention is an index showing the degree of surface unevenness of toner particles. It is indicated as 1.000 when the toner particles are perfectly spherical. The more complicate the surface shape is, the smaller the value of circularity is.

Average circularity C which means an average value of circularity frequency distribution is calculated from the following expression where the circularity at a partition point i of particle size distribution (a central value) is represented by ci, and the number of particles measured by m.

$$\text{Average circularity } C = \sum_{i=1}^{m} ci/m.$$

Incidentally, the measuring instrument FPIA-2100 used in the present invention calculates the circularity of each particle and thereafter calculates the average circularity, where, according to circularities obtained, particles are divided into classes in which circularities of from 0.400 to 1.000 are equally divided at intervals of 0.010, and the average circularity is calculated using the divided-point center values and the number of particles measured.

The measuring instrument "FPIA-2100" used in the present invention is, compared with "FPIA-1000" used conventionally to calculate the shape of toner particles, an instrument having been improved in precision of measurement of toner particle shapes because of an improvement in magnification of processed particle images and also an improvement in processing resolution of images captured (256×256–>512×512), and therefore having achieved surer capture of finer particles. Accordingly, where the particle shapes must more accurately be measured as in the present invention, FPIA-2100 is more useful, with which the information concerned with particle shapes can more accurately be obtained.

As a specific way of the measurement of average circularity using FPIA-2100, 10 ml of ion-exchanged water from which impurity solid matter or the like has been removed is made ready in a container, and a surface active agent, preferably alkylbenzenesulfonate, is added thereto as a dispersant. Thereafter, toner base particles are further added in an amount of 0.02 g, and are uniformly dispersed. As a means for dispersing the particles, an ultrasonic dispersion mixer "TETORA 150 Model" (manufactured by Nikkaki Bios Co.) is used, and dispersion treatment is carried out for 2 minutes to prepare a liquid dispersion for measurement. In that case, the liquid dispersion is appropriately cooled so that its temperature does not come to 40° C. or more. Also, in order to keep the circularity from scattering, the flow type particle image analyzer FPIA-2100 is installed in an environment controlled to 23° C.±0.5° C. so that its in-machine temperature can be kept at 26 to 27° C., and autofocus control is performed using 2 μm latex particles at intervals of constant time, and preferably at intervals of 2 hours. At the time of measurement, the concentration of the liquid dispersion is so controlled that the concentration of toner base particles is 3,000 to 10,000 particles/μl, where 1,000 or more toner base particles are measured. After the measurement, using the data obtained, the data of particles with a circle-equivalent diameter of less than 3.00 μm are cut, and the average circularity of the toner base particles is determined.

As to the number frequency cumulative value of the circularity of the toner base particles, the number frequency cumulative value of the particles having a circularity of 0.960 or more and that of the particles having a circularity of 0.920 or less are calculated using the above data in which circularities of from 0.400 to 1.000 are divided into 61 classes. Also, as to particle size distribution of circle-equivalent diameters of toner base particles, the content of particles present having a circle-equivalent diameter in the range specified in the present invention is found in % by number from particle diameter frequency data in which circle-equivalent diameters are divided into 226 in the range of from 0.60 μm to 400 μm.

(2) Measurement of Average Surface Roughness:

In the present invention, the average surface roughness of the toner base particles is measured with a scanning probe microscope. An example of measuring methods is shown below.

Probe station: SPI3800N (manufactured by Seiko Instruments Inc.).

Measuring unit: SPA400.

Measuring mode: DFM (resonance mode)-shaped images.

Cantilever: SI-DF40P.

Resolution: 256 in number of X-data; 128 in number of Y-data.

In the present invention, areas of 1 μm square of the particle surfaces of the toner base particles are measured. The areas to be measured are areas of 1 μm square at middle portions, of the particle surfaces of the toner base particles which are measured with the scanning probe microscope. As the toner base particles to be measured, toner base particles which have particle diameters equal to weight-average particle diameter (D4) measured by the Coulter counter method are picked out at random, and the toner base particles thus picked out are measured. Data obtained by measurement are subjected to secondary correction. Five or more particles of different toner base particles are measured, and an average value of the data obtained is calculated to find the average surface roughness of the toner base particles.

In the toner in which external additives such as inorganic fine particles have externally been added to the toner base particles, the external additives must be removed from toner particle surfaces when the surface properties of the toner base particles are measured with the scanning probe microscope. As a specific method therefor, the following method is available, for example.

1) 45 g of the toner is put into a sample bottle, and 10 ml of methanol is added thereto.

2) The sample is dispersed for 1 minute by means of an ultrasonic cleaning machine to make the external additives separate.

3) The toner base particles and the external additives are separated by suction filtration (a 10 μm membrane filter). In the case of a toner containing a magnetic material, a magnet may be touched to the bottom of the sample bottle to make the toner base particles stationary so that only the supernatant liquid may be separated.

4) The above 2) and 3) are carried out three times in total, and the resultant toner base particles are well dried at room temperature by means of a vacuum dryer.

The toner base particles, from which the external additives have been removed, are observed on a scanning electron microscope. After making sure that the external additives have disappeared, the surfaces of the toner base particles may be observed with the scanning probe microscope. If the external additives have not well completely been removed, the steps 2) and 3) are repeated until the external additives are sufficiently removed, and thereafter the surfaces of the toner base particles are observed with the scanning probe microscope.

As another method for removing the external additives in place of the steps 2) and 3), a method is available in which the external additives are made to dissolve with an alkali. As the alkali, an aqueous sodium hydroxide solution is preferred.

In the present invention, the average surface roughness (Ra) is what has three-dimensionally been so extended that the center-line average roughness Ra defined in JIS B 0601 is applicable to measuring faces. It is the value found by averaging absolute values of deviations from the reference face to the specified face, and is expressed by the following equation.

$$Ra = \frac{1}{S_0}\int_{Y_B}^{Y_T}\int_{X_L}^{X_R}|F(X, Y) - Z_0|dXdY$$

where;

F(X, Y) is the face where the whole measurement data stand;

$S_0$ is the area found when the specified face is supposed to be ideally flat; and $Z_0$ is the average value of Z-data in the specified face.

In the present invention, the specified face is meant to be the measuring area of 1 μm square.

(3) Measurement of Maximum Endothermic Peak of Release Agent and Toner:

Temperature curve:

Heating I (30° C. to 200° C.; heating rate: 10° C./min)

Cooling I (200° C. to 30° C.; Cooling rate: 10° C./min).

Heating II (30° C. to 200° C.; heating rate: 10° C./min).

The maximum endothermic peak of the toner is measured with a differential scanning calorimeter (DSC measuring instrument) DSC2920 (manufactured by TA Instruments Japan Ltd.). It is measured according to ASTM D3418-82.

A sample for measurement is precisely weighed in an amount of from 5 to 20 mg, preferably 10 mg. This sample is put in an aluminum pan and an empty aluminum pan is used as reference. Measurement is made in a normal-temperature and normal-humidity environment at a heating rate of 10° C./min within the measuring temperature range of from 30° C. to 200° C. To determine the maximum endothermic peak of the toner, in the course of Heating II, a peak which is highest as the height from the base line of a region beyond endothermic peaks of the glass transition temperature (Tg) of the resin, or, when the endothermic peaks of the glass transition temperature (Tg) of the resin overlap with different endothermic peaks and are difficult to distinguish, a peak which is highest in maximum peaks of the peaks overlapping, is regarded as the maximum endothermic peak of the toner of the present invention.

(4) Measurement of Acid Value:

Basic operation is made according to JIS K-0070.

1) A crushed product of a sample is precisely weighed in an amount of from 0.5 to 2.0 g, and the weight of the sample is represented by W (g).

2) The sample is put in a 300 ml beaker, and 150 ml of a toluene/ethanol (4/1) mixed solvent is added thereto to dissolve the sample.

3) Using an ethanol solution of 0.1 mol/l of KOH, titration is made by means of a potentiometric titrator. (For example, automatic titration may be utilized which is made using a potentiometric titrator AT-400, WIN WORKSTATION, and an ABP-410 motor burette, manufactured by Kyoto Electronics Manufacturing Co., Ltd.)

4) The amount of the KOH solution used here is represented by S (ml). A blank is measured at the same time, and the amount of the KOH solution used in the blank is represented by B (ml).

5) The acid value is calculated according to the following expression. Letter symbol f is the factor of KOH.

Acid value(mg·KOH/g)={(S-B)×f×5.61}/W.

(5) Glass Transition Temperature of Resin:

The glass transition temperature (Tg) of the resin is measured according to ASTM D3418-82, using a differential scanning calorimeter (DSC measuring instrument) DSC2920 (manufactured by TA Instruments Japan Ltd.).

A sample for measurement is precisely weighed in an amount of 5 to 20 mg, and preferably 10 mg. This sample is put in an aluminum pan and an empty aluminum pan is used as reference. Measurement is made in a normal-temperature and normal-humidity environment at a heating rate of 10° C./min within the measurement range of from 30° C. to 200° C. In the course of this heating, changes in specific heat are obtained within the range of temperature of from 40° C. to 100° C. The point of intersection of i) the middle-point line between the base lines before and after the appearance of the changes in specific heat thus obtained and ii) the differential thermal curve is regarded as the glass transition point (Tg).

(6) Measurement of Softening Point of Resin:

The softening point refers to what is measured with a fall-type flow tester according to JIS K 7210. A specific measuring method is shown below. Using a fall-type flow tester manufactured by Shimadzu Corporation, 1 $cm^3$ of a sample is heated at a heating rate of 6° C./min, during which a load of 1,960 $N/m^2$ (20 $kg/cm^2$) is applied by means of a plunger, and a nozzle of 1 mm in diameter and 1 mm in length is so made as to be pushed out, whereby a plunger fall level (flow value)—temperature curve is drawn. Where the height of its sigmoid (S-shaped) curve is represented by h, the temperature corresponding to h/2 (temperature at which a half of the resin has flowed out) is regarded as the softening point (Tm) of the resin.

(7) Evaluation of Charge Stability:

FIG. 1 illustrates a device for measuring triboelectric charge quantity. About 0.5 to 1.5 g of a two-component developer collected from the developing sleeve surface of a copying machine or a printer is put in a measuring container 52 made of a metal at the bottom of which a screen 53 of 30 μm in mesh opening (500 meshes) is provided, and the container is covered with a plate 54 made of a metal. The total weight of the measuring container 52 at this point is weighed and is expressed as W1 (g). Next, in a suction device 51 (made of an insulating material at least at the part coming into contact with the measuring container 52), air is sucked from a suction opening 57 and an air-flow control valve 56 is operated to control the pressure indicated by a vacuum indicator 55, to be 4 kPa. In this state, suction is sufficiently carried out, preferably for about 2 minutes, to remove the toner by suction. The potential indicated by a potentiometer 59 at this point is expressed as V (volt). Here, reference numeral 58 denotes a capacitor, whose capacitance is expressed as C (μF). The total weight of the measuring container after the suction is also weighed and is expressed as W2 (g). The triboelectric charge quantity (mC/kg) of this sample is calculated as in the following expression.

Triboelectric charge quantity (*m*C/kg) of sample=C×V/(W1−W2).

(Here, measuring conditions are set to be 23° C., 50% RH.)

In practice, using an altered machine of a color copying machine CLC-1000 (manufactured by CANON INC.), from which an oil application mechanism of its fixing unit has been removed, a 50,000-sheet running test was conducted in a monochromatic mode, using an original with an image area percentage of 7% in a normal-temperature and low-humidity environment (23° C./5% RH) and in a high-temperature and high-humidity environment (30° C./80% RH). Triboelectric charge quantity at the initial stage and that after 50,000-sheet running in the normal-temperature and low-humidity environment (23° C./5% RH) were evaluated according to the following evaluation criteria.

(Evaluation Criteria)

A: The difference Δ in triboelectric charge quantity between that at the initial stage and that after the 50,000-sheet running is less than 5.

B: The difference Δ in triboelectric charge quantity between that at the initial stage and that after the 50,000-sheet running is 5 or more to less than 10.

C: The difference Δ in triboelectric charge quantity between that at the initial stage and that after the 50,000-sheet running is 10 or more to less than 15.

D: The difference Δ in triboelectric charge quantity between that at the initial stage and that after the 50,000-sheet running is 15 or more.

(8) Molecular Weight Distribution by Measurement by GPC:

Molecular weight on a chromatogram by gel permeation chromatography (GPC) of the binder resin is measured under the following conditions.

Columns are stabilized in a heat chamber of 40° C. To the columns kept at this temperature, tetrahydrofuran (THF) as a solvent is flowed at a flow rate of 1 ml per minute, and about 50 to 200 μl of a THF sample solution of resin which has been regulated to have a sample concentration of from 0.05 to 0.60% by weight is injected thereinto to make measurement. In measuring the molecular weight of the sample, the molecular weight distribution the sample has is calculated from the relationship between the logarithmic value of a calibration curve prepared using several kinds of monodisperse polystyrene standard samples and the count number (retention time). As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Tosoh Corporation or Pressure Chemical Co., and to use at least about 10 standard polystyrene samples. An RI (refractive index) detector is used as a detector.

As columns, in order to make precise measurement in the region of molecular weight of from 1,000 to 2,000,000, it is desirable to use a plurality of commercially available polystyrene gel columns in combination. For example, they may preferably comprise a combination of Shodex GPC KF-801, KF-802, KF-803, KF-804, KF-805, KF-806 and KF-807, available from Showa Denko K. K., and μ-Styragel 500, 1,000, 10,000 and 100,000, available from Waters Co.

(9) Measurement of Particle Size Distribution of Toner:

In the present invention, the average particle diameter and particle size distribution of the toner are measured with a Coulter counter Model TA-II (manufactured by Coulter Electronics, Inc.). Coulter Multisizer (manufactured by Coulter Electronics, Inc.) may also be used. As an electrolytic solution, an aqueous 1% NaCl solution is prepared using first-grade sodium chloride. For example, ISOTON R-II (available from Coulter Scientific Japan Co.) may be used. Measurement is made by adding as a dispersant 0.1 to 5 ml of a surface active agent, preferably an alkylbenzenesulfonate, to 100 to 150 ml of the above aqueous electrolytic solution, and further adding 2 to 20 mg of a sample for measurement. The electrolytic solution in which the sample has been suspended is subjected to dispersion treatment for about 1 minute to about 3 minutes in an ultrasonic dispersion machine. The volume distribution and number distribution of the toner are calculated by measuring the volume and number of toner particles of 2.00 μm or larger diameter by means of the above measuring instrument, using an aperture of 100 μm as its aperture. Then the weight-based, weight average particle diameter (D4) (the middle value of each channel is used as the representative value for each channel) according to the present invention, determined from the volume distribution of toner particles, are determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

(10) Evaluation of Transfer Efficiency:

In regard to the transfer efficiency of the toner, it was evaluated according to the following evaluation method and evaluation criteria, after 50,000-sheet running in a normal-temperature and low-humidity environment (23° C./5% RH). Using a color copying machine CLC-1000 (manufactured by CANON INC.), the potential contrast of its photosensitive member was so controlled that the toner laid-on quantity on the photosensitive member came to be 0.6 mg/cm$^2$. Image density of images transferred onto a transfer sheet and that of transfer residual images on the photosensitive member were measured with a densitometer (X-RITE 500 Series). The toner laid-on quantity was calculated from each image density to find transfer efficiency of toner to the transfer sheet. Incidentally, as transfer current, a value was used which was so controlled that the transfer efficiency was maximum.

The density of images taken by taping the transfer residual part on the drum (photosensitive member) and then stuck on paper is represented by D1, and the density of images taken by taping the images transferred to paper by D2. Calculated as: Transfer efficiency (%)=D2/(D1+D2)×100.

(Evaluation Criteria)

A: Transfer efficiency after 50,000-sheet (50 k, in Table 4) running is 92% or more.

B: Transfer efficiency after 50,000-sheet running is 87% or more to less than 92%.

C: Transfer efficiency after 50,000-sheet running is 80% or more to less than 87%.

D: Transfer efficiency after 50,000-sheet running is less than 80%.

(11) Fixable Range:

Using an altered machine of a fixing unit of LASER JET 4100 (manufactured by Hewlett-Packard Co.), a fixing test was conducted in the state the fixing unit was so altered that its fixing temperature was able to be manually set. Images were reproduced using CLC-1000 in a monochromatic mode and in a normal-temperature and normal-humidity environment (23° C./60% RH), where development contrast was so controlled that the toner laid-on quantity on paper was 1.2 mg/cm$^2$, to form unfixed images. The unfixed images were formed in an image area percentage of 25% on A4 sheets (TKCL A4, CLC-recomended paper). The unfixed images were fixed in the normal-temperature and normal-humidity environment (23° C./60% RH), raising temperature at intervals of 10° C. from 120° C., where the temperature width in which any offset or wind-around did no occur was regarded as the fixable range.

(Evaluation Criteria)

A: Fixing width is 50° C. or more.

B: Fixing width is 40° C. or more to less than 50° C.

C: Fixing width is 20° C. or more to less than 40° C.

D: Fixing width is less than 20° C.

(12) Anti-Blocking Properties:

About 10 g of the toner was put into a 100 ml polyethylene cup. This was left for 3 days at 50° C., and thereafter visually observed to make evaluation.

(Evaluation Criteria)

A: No agglomerate is seen.

B: Agglomerates are seen, but are readily collapsible.

C: Agglomerates are seen, but are collapsible when shaken.

D: Agglomerates are holdable, and are not easily collapsible.

(13) Faulty Cleaning (Cleaning Performance):

In 10,000-sheet running using CLC-1000, it comes that faulty cleaning has occurred when vertical lines or spotlike marks of residual toner not removed by cleaning come appeared on images.

(Evaluation Criteria)

A: No image defect is seen at all.

B: Two or three spotlike marks appear.

C: Spotlike or stripelike marks somewhat appear.

D: Spotlike and stripelike marks and density non-uniformity appear.

(14) Evaluation on Toner-Spent of Carrier:

Using a washing agent, toner was separated from the developer after copying on 10,000 sheets using CLC-2150, to take out the carrier only. From 20 g of this carrier washed out, the resin with which carrier particles had been coated and the toner components having been spent were extracted with 20 cc of methyl ethyl ketone. A virgin carrier was also likewise treated. The resultant both liquids were diluted into 10 ml, and its transmittance was measured at 500 nm using a spectrophotometer. Evaluated by a difference Δ in transmittance between the former carrier and the latter virgin carrier.

A: Difference in transmittance is less than 7%.

B: Difference in transmittance is 7% or more to less than 12%.

C: Difference in transmittance is 12% or more to less than 17%.

D: Difference in transmittance is 17% or more to less than 21%.

E: Difference in transmittance is 21% or more.

(15) Light Transmittance in Aqueous 45% by Volume Methanol Solution:

(i) Preparation of Toner Dispersion:

An aqueous solution is prepared in which the volume mixing ratio of methanol to water is 45:55. Then, 10 ml of this aqueous solution is put into a 30 ml sample bottle (SV-30, available from Nichiden-Rika Glass Co., Ltd.), and 20 mg of the toner is soaked therein at the liquid surface, where the bottle is closed. Thereafter, this bottle is shaked at 2.5 $S^{-1}$ for 5 seconds by means of Yayoi shaker (model: YS-LD). Here, the angle of shaking is so set that the support of shaking moves forward by 15 degrees and backward by 20 degrees regarding the just above position (vertical) of the shaker as 0 degree. The sample bottle is fastened to a fastening holder attached to the end of the support (the cover of the sample bottle is fastened to the center of the support on its extension). After the sample bottle is taken out, a liquid dispersion after lapse of 30 seconds is used as a liquid dispersion for measurement.

(ii) Measurement of Transmittance:

The liquid dispersion obtained in the step (i) is put into a 1 cm square quartz cell, and the transmittance (%) of light of 600 nm in wavelength with respect to the liquid dispersion after 10 minutes is measured with a spectrophotometer MPS2000 (manufactured by Shimadzu Corporation).

Light transmittance (%)=$I/I_0 \times 100$ where I: transmitted-light flux; $I_0$: incident-light flux.

EXAMPLES

The present invention is described below by giving specific working examples. The present invention is by no means limited to these examples.

Hybrid Resin

Production Example

As vinyl polymer unit materials, 1.9 mols of styrene, 0.21 mol of 2-ethylhexyl acrylate, 0.15 mol of fumaric acid, 0.03 mol of a dimer of α-methylstyrene and 0.05 mols of dicumyl peroxide were put into a dropping funnel. Also, 7.0 mols of polyoxypropylene(2.2)-2,2-bis(4-hydroxyphenyl)propane, 3.0 mols of polyoxyethylene(2.2)-2,2-bis(4-hydroxyphenyl) propane, 3.0 mols of terephthalic acid, 2.0 mols of trimellitic anhydride, 5.0 mols of fumaric acid and 0.2 g of tin 2-ethyhexanoate were put into a 4-liter four-necked flask made of glass, and a thermometer, a stirring rod, a condenser and a nitrogen feed tube were attached thereto. This was placed in a mantle heater. Next, the inside atmosphere of the flask was displaced with nitrogen gas, followed by gradual heating with stirring. With stirring at a temperature of 145° C., the monomers, cross-linking agent and polymerization initiator for the vinyl polymer unit were dropwise added over a period of 4 hours from the above dropping funnel. Then, these were heated to 200° C. to carry out reaction for 4 hours to obtain a hybrid resin (Tm: 118° C.; Tg: 63° C.; acid value: 27 mg·KOH/g). The hybrid resin obtained is designated as Resin A. Results of measurement of molecular weight by GPC are shown in Table 1.

Polyester Resin

Production Example 3.6 mols of polyoxypropylene(2.2)-2,2-bis(4-hydroxyphenyl)propane, 1.6 mols of polyoxyethylene(2.2)-2,2-bis(4-hydroxyphenyl) propane, 1.7 mols of terephthalic acid, 1.1 mols of trimellitic anhydride, 2.4 mols of fumaric acid and 0.1 g of tin 2-ethyhexanoate were put into a 4-liter four-necked flask made of glass, and a thermometer, a stirring rod, a condenser and a nitrogen feed tube were attached thereto. This was placed in a mantle heater. In an atmosphere of nitrogen, reaction was carried out at 215° C. for 5 hours to obtain a polyester resin (Tm: 110° C.; Tg: 52° C.; acid value: 15 mg·KOH/g). The polyester resin obtained is designated as Resin B. Results of measurement of molecular weight by GPC are shown in Table 1.

Styrene-acrylate Resin
Production Example

| | (by weight) |
|---|---|
| Styrene | 70 parts |
| n-Butyl acrylate | 24 parts |
| Monobutyl maleate | 6 parts |
| Di-tert-butyl peroxide | 1 part |

In a four-necked flask, with stirring of 200 parts by weight of xylene, the inside atmosphere of the container was sufficiently displaced with nitrogen, where its content was heated to 120° C. Thereafter, the above materials were dropwise added thereto over a period of 3.5 hours. Further, polymerization was completed under reflux of xylene, and the solvent was removed by distillation under reduced pressure to obtain a styrene-acrylate resin (Tm: 105° C.; Tg: 60° C.; acid value: 1.5 mg·KOH/g). The styrene-acrylate resin obtained is designated as Resin C. Results of measurement of molecular weight by GPC are shown in Table 1.

TABLE 1

| | | Molecular weight GPC measurement results | | |
|---|---|---|---|---|
| | Type of resin | Mw ($\times 10^3$) | Mn ($\times 10^3$) | Mw/Mn |
| Resin A: | Hybrid resin | 83.0 | 3.1 | 26.8 |
| Resin B: | Polyester resin | 15.0 | 2.1 | 7.1 |
| Resin C: | Styrene-acrylate resin | 80.4 | 6.7 | 12.0 |

Waxes used in the present invention are shown in Table 2.

TABLE 2

| | Type of wax | Melting point |
|---|---|---|
| Wax (A): | Purified normal paraffin | 75.0° C. |
| Wax (B): | Purified Fischer-Tropsch | 88.0° C. |
| Wax (C): | Purified normal paraffin | 70.2° C. |
| Wax (D): | Purified normal paraffin | 65.8° C. |
| Wax (E): | Fischer-Tropsch | 103.1° C. |
| Wax (F): | Polyethylene | 111.3° C. |
| Wax (G): | Purified normal paraffin | 58.2° C. |

Example 1

Cyan Toner 1 was prepared in the following way.

First Kneading Step;

| | (by weight) |
|---|---|
| Resin A | 70 parts |
| First pasty pigment with 30% by weight of solid content, obtained by removing water to a certain extent from a pigment slurry containing C.I. Pigment Blue 15:3, without having passed through any drying step at all (remaining 70% by weight: water) | 100 parts |

The above raw materials were first introduced into a kneader type mixer, and were heated with mixing under application of no pressure. At the time the resultant mixture reached a maximum temperature (which depends necessarily on the boiling point of a solvent in the paste; in this case, about 90 to 100° C.), the pigment in aqueous phase became distributed or moved to the molten resin phase. Having made sure of this, the mixture was further melt-kneaded for 30 minutes with heating to cause the pigment in the paste to move sufficiently to the resin phase. Thereafter, the mixer was first stopped, and the hot water was discharged. Then the mixture was further heated to 130° C. and melt-kneaded for about 30 minutes with heating to disperse the resin, and at the same time the water was evaporated off, to stop the kneading step, followed by cooling to take out the kneaded product to obtain a first kneaded product. This first kneaded product had a water content of about 0.5% by weight.

Second Kneading Step:

| | (by weight) |
|---|---|
| The above first kneaded product (content of pigment particles: 30% by weight) | 10.0 parts |
| Resin A | 100.0 parts |
| Wax (A) | 5.0 parts |
| Aluminum compound of 3,5-di-tert-butylsalicylic acid (charge control agent) | 1.0 part |

Materials formulated as shown above were premixed by means of Henschel mixer, and the mixture obtained was melt-kneaded using a twin-screw extrusion kneader, setting its temperature at 100° C. The kneaded product obtained was cooled and thereafter crushed by means of a hammer mill into a crushed product of about 1 to 2 mm in diameter. The crushed product was then finely pulverized by means of a fine grinding mill of an air jet system into particles of about 20 μm or less in diameter, repeating pulverization twice. The finely pulverized product thus obtained was further classified by means of Elbow Jet classifier to obtain a median powder. This median powder was subjected to classification and spherical treatment by means of the surface modifying apparatus (apparatus A, in Table 3) which simultaneously carries out classification and surface modification treatment making use of a mechanical impact force, to obtain cyan type resin particles (classified product) which are toner base particles having a volume-average particle diameter of 7.2 μm in particle size distribution, an average circularity of 0.935 and an average surface roughness of 22.5 nm.

Thereafter, as inorganic fine particles, 1.5 parts by weight of fine titanium oxide particles of 50 nm in primary average particle diameter which were surface-treated with isobutyltrimethoxysilane were externally added to 100 parts by weight of the above cyan type resin particles to obtain Cyan Toner 1. Its toner constitution and the results of measurement of particle shapes (physical properties) are shown in Table 3.

Cyan Toner 1 was further blended with magnetic ferrite carrier particles (average particle diameter: 45 μm) surface-coated with silicone resin, which were so blended as to be in a toner concentration of 7% by weight. Thus, Two-component Cyan Developer 1 was obtained. As shown in Table 4, this developer showed a good transfer efficiency and also a good fixable range. Further, even after 50,000-sheet running, charge variations were small with respect to the initial stage, there was also no problem on cleaning performance, and cyan images having faithfully reproduced an original were obtained.

Example 2

Cyan Toner 2 was produced in the same manner as in Example 1 except that Wax (B) was used as the release agent. Cyan Developer 2 was obtained in the same way. Measurement and evaluation were made in variety in the same manner as in Example 1. The results of the measurement and evaluation are shown in Tables 3 and 4.

Example 3

Cyan Toner 3 was produced in the same manner as in Example 1 except that Wax (C) was used as the release agent. Cyan Developer 3 was obtained in the same way. Measurement and evaluation were made in variety in the same manner as in Example 1. The results of the measurement and evaluation are shown in Tables 3 and 4.

Example 4

Magenta Toner 1 was produced in the same manner as in Example 1 except that C.I. Pigment Red 57 was used as the colorant. Magenta Developer 1 was obtained in the same way. Measurement and evaluation were made in variety in the same manner as in Example 1. The results of the measurement and evaluation are shown in Tables 3 and 4.

Example 5

Yellow Toner 1 was produced in the same manner as in Example 1 except that C.I. Pigment Yellow 74 was used as the colorant. Yellow Developer 1 was obtained in the same way. Measurement and evaluation were made in variety in the same manner as in Example 1. The results of the measurement and evaluation are shown in Tables 3 and 4.

Example 6

Black Toner 1 was produced in the same manner as in Example 1 except that carbon black was used as the colorant. Black Developer 1 was obtained in the same way. Measurement and evaluation were made in variety in the same manner as in Example 1. The results of the measurement and evaluation are shown in Tables 3 and 4.

Example 7

Magenta Toner 2 was produced in the same manner as in Example 4 except that Wax (D) was used as the release agent and C.I. Pigment Red 122 was used as the colorant. Magenta Developer 2 was obtained in the same way. Measurement and evaluation were made in variety in the same manner as in Example 1. The results of the measurement and evaluation are shown in Tables 3 and 4.

Example 8

Yellow Toner 2 was produced in the same manner as in Example 5 except that Wax (E) was used as the release agent and C.I. Pigment Yellow 110 was used as the colorant. Yellow Developer 2 was obtained in the same way. Measurement and evaluation were made in variety in the same manner as in Example 1. The results of the measurement and evaluation are shown in Tables 3 and 4.

Example 9

Cyan Toner 4 was produced in the same manner as in Example 1 except that a blend of Resin A and Resin B (blend ratio: 50 parts/50 parts) was used as the binder resin and Wax (D) was used as the release agent. Cyan Developer 4 was obtained in the same way. Measurement and evaluation were made in variety in the same manner as in Example 1. The results of the measurement and evaluation are shown in Tables 3 and 4.

Example 10

Cyan Toner 5 was produced in the same manner as in Example 1 except that Resin B was used as the binder resin, Wax (E) was used as the release agent and titanium oxide and silica were used in combination as the inorganic fine particles. Cyan Developer 5 was obtained in the same way. Measurement and evaluation were made in variety in the same manner as in Example 1. The results of the measurement and evaluation are shown in Tables 3 and 4.

Example 11

Cyan Toner 6 was produced in the same manner as in Example 1 except that a blend of Resin A and Resin C (blend ratio: 50 parts/50 parts) was used as the binder resin, Wax (D) was used as the release agent and titanium oxide and silica were used in combination as the inorganic fine particles. Cyan Developer 6 was obtained in the same way. Measurement and evaluation were made in variety in the same manner as in Example 1. The results of the measurement and evaluation are shown in Tables 3 and 4.

Comparative Example 1

Cyan Toner 7 was produced in the same manner as in Example 11 except that, in place of using the apparatus which simultaneously carries out classification and surface smoothing treatment making use of a mechanical impact force, Elbow Jet classifier was used as a classifying apparatus and titanium oxide was used alone as the inorganic fine particles. Cyan Developer 7 was obtained in the same way. Elbow Jet classifier did not afford a high average circularity, resulting in very inferior transfer efficiency. The results of measurement and evaluation are shown in Tables 3 and 4.

Comparative Example 2

Cyan Toner 8 was produced in the same manner as in Example 10 except that Wax (F) was used as the release agent and silica was used alone as the inorganic fine particles. Cyan Developer 8 was obtained in the same way. Probably because the fine silica particles came greatly buried in toner base particles, charge stability was greatly inferior. The results of measurement and evaluation are shown in Tables 3 and 4.

Comparative Example 3

Cyan Toner 9 was produced in the same manner as in Example 1 except that Resin C was used as the binder resin, Wax (G) was used as the release agent, silica was used alone as the inorganic fine particles and, in place of using the apparatus which simultaneously carries out classification and surface modification treatment making use of a mechanical impact force, Elbow Jet classification and a thermospherical treatment apparatus were used. Cyan Developer 9 was obtained in the same way. As shown in Tables 3 and 4, very poor results were obtained on all evaluation items.

Comparative Example 4

Cyan Toner 10 was produced in the same manner as in Example 1 except that Resin C was used as the binder resin, Wax (G) was used as the release agent and silica was used alone as the inorganic fine particles. Cyan Developer 10 was obtained in the same way. As shown in Tables 3 and 4, low charging came about because of faulty cleaning, and besides very poor results were obtained on all evaluation items.

Examples 12

Figure 5:
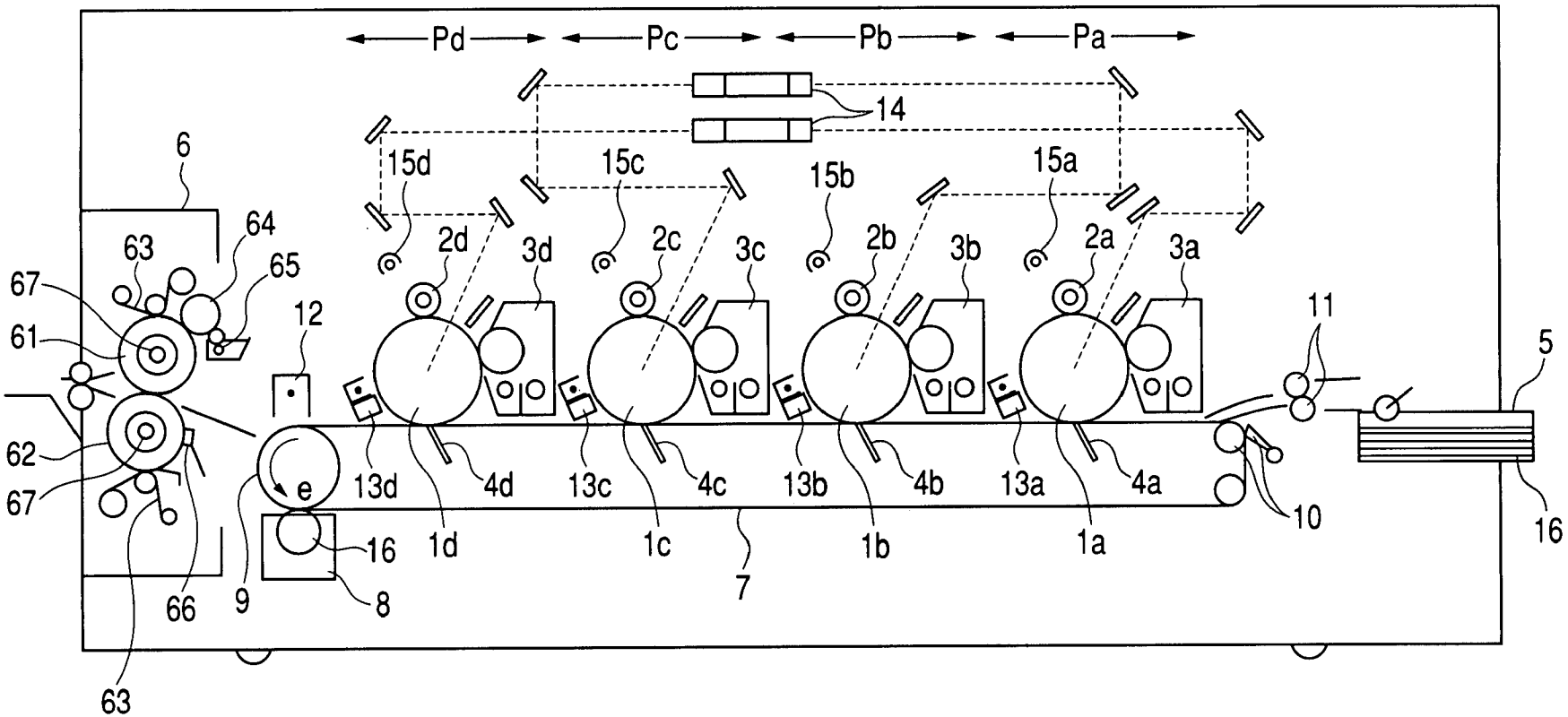
FIG. 5 is a schematic view of an image forming apparatus which carries out the image formation method of the present invention.

Using Magenta Developer 1, Yellow Developer 1, Cyan Developer 1 and Black Developer 1, images were reproduced using an image forming apparatus CLC-1000 (four-unit tandem type, having no intermediate transfer member) shown in FIG. 5. As the result, full-color images which reproduced an original faithfully were obtainable. Full-color images which reproduced an original faithfully were further obtained also after 50,000-sheet running, like the initial stage image reproduction. Incidentally, in FIG. 5, reference numerals 1*a*, 1*b*, 1*c* and 1*d* denote photosensitive drums; 2*a*, 2*b*, 2*c* and 2*d*, charging assemblies; 3*a*, 3*b*, 3*c* and 3*d*, developing assemblies; 4*a*, 4*b*, 4*c* and 4*d*, transfer blades; 5, a recording material; 6, a fixing assembly; 61, a fixing roller; 62, a pressure roller; 63, a cleaning web; 64, an oil application roller; 65, a fixing oil; 66, a thermoswitch; 67, a heating element; 7, a recording material carrying member (transfer belt); 8, a transfer belt cleaning assembly; 9, a drive roller; 10, a belt destaticizer; 11, registration rollers; 12, a separation charging assembly; 13*a*, 13*b*, 13*c* and 13*d*, destaticizers; 14, polygon mirrors; 15*a*, 15*b*, 15*c* and 15*d*, erase exposure units; and 16, a recording material holder.

Example 13

Figure 6:
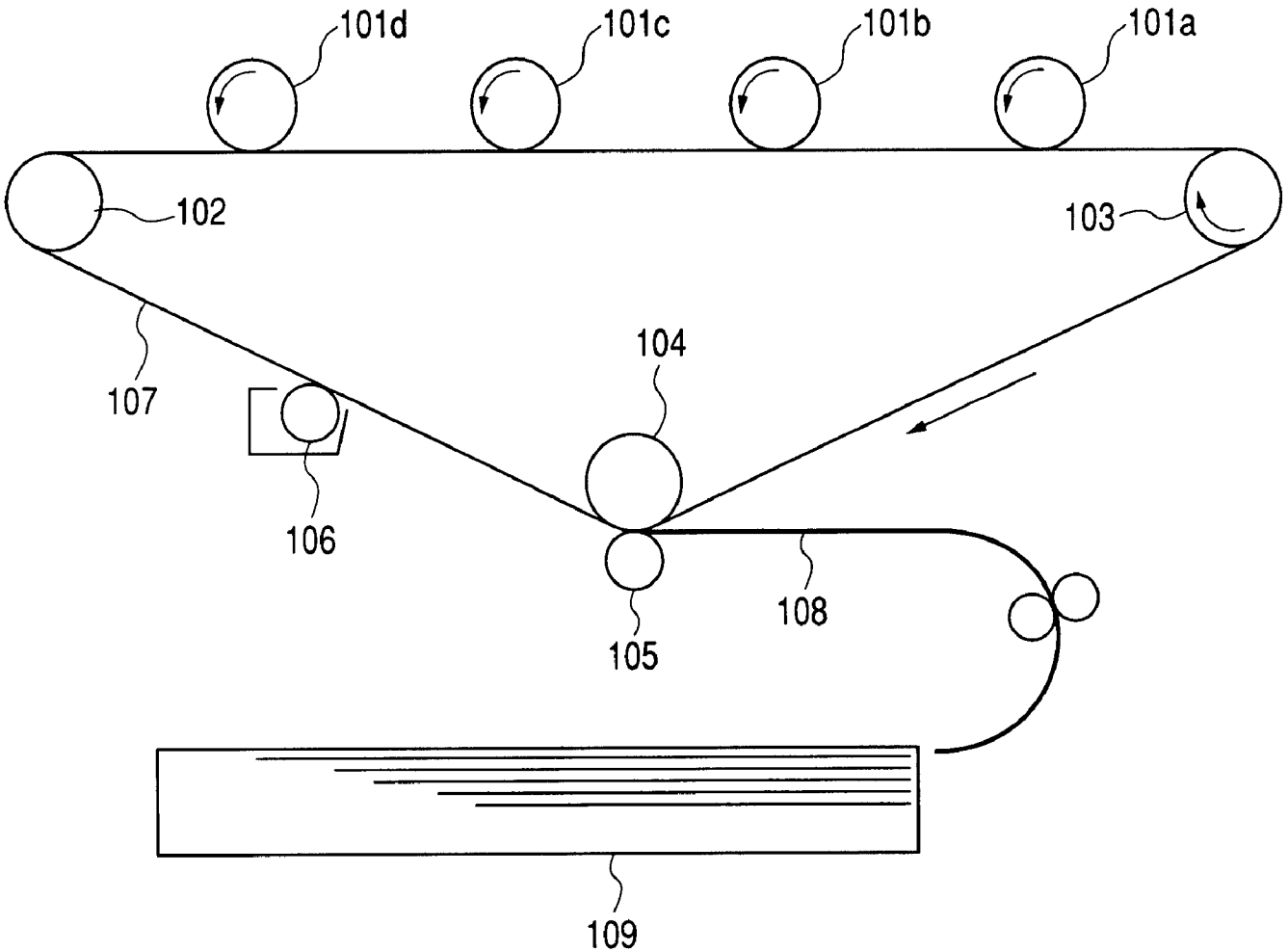
FIG. 6 is a schematic view of an intermediate transfer member and its vicinity, of the image forming apparatus which carries out the image formation method of the present invention.

Images were reproduced in the same manner as in Example 12 except that an image forming apparatus was used in which CLC-1000 used in Example 12 was so altered as to have an intermediate transfer member as shown in FIG. 6. As the result, full-color images which reproduced an original faithfully were obtainable. Full-color images which reproduced an original faithfully were further obtained also after 50,000-sheet running, like the initial stage image reproduction. Incidentally, in FIG. 6, reference numerals 101*a*, 101*b*, 101*c* and 101*d* denote photosensitive drums; 102, a tension roller; 103, a drive roller; 104, a secondary transfer opposing roller; 105, a secondary transfer roller; 106, a belt cleaning means; 107, an intermediate transfer belt (intermediate transfer member); 108, a recording material; and 109, a recording material holder.

TABLE 3(A)

| | Toner constitution | | | | | Apparatus | |
|---|---|---|---|---|---|---|---|
| Toner No. | Binder resin | Release agent | Colorant | Charge control agent | Inorganic fine particles | Pulverizer | Classifier |
| 1 Cyan Toner 1 | Resin A | Wax (A) | P.B. 15 | Sali.Al comp. | $TiO_2$ | Air | App. A |
| 2 Cyan Toner 2 | Resin A | Wax (B) | P.B. 15 | Sali.Al comp. | $TiO_2$ | Air | App. A |
| 3 Cyan Toner 3 | Resin A | Wax (C) | P.B. 15 | Sali.Al comp. | $TiO_2$ | Air | App. A |
| 4 Magenta Toner 1 | Resin A | Wax (A) | P.B. 57 | Sali.Al comp. | $TiO_2$ | Air | App. A |
| 5 Yellow Toner 1 | Resin A | Wax (A) | P.B. 74 | Sali.Al comp. | $TiO_2$ | Air | App. A |
| 6 Black Toner 1 | Resin A | Wax (C) | Carbon black | Sali.Al comp. | $TiO_2$ | Air | App. A |
| 7 Magenta Toner 2 | Resin A | Wax (D) | P.B. 15 | Sali.Al comp. | $TiO_2$ | Air | App. A |
| 8 Yellow Toner 2 | Resin A | Wax (E) | P.B. 110 | Sali.Al comp. | $TiO_2$ | Air | App. A |
| 9 Cyan Toner 4 | Resins A, B | Wax (D) | P.B. 15 | Sali.Al comp. | $TiO_2$ | Air | App. A |
| 10 Cyan Toner 5 | Resin B | Wax (E) | P.B. 15 | Sali.Al comp. | $TiO_2 + SiO_2$ | Air | App. A |
| 11 Cyan Toner 6 | Resins A, C | Wax (D) | P.B. 15 | Sali.Al comp. | $TiO_2 + SiO_2$ | Air | App. A |
| 12 Cyan Toner 7 | Resins A, C | Wax (D) | P.B. 15 | Sali.Al comp. | $TiO_2$ | Air | Elbow J. |
| 13 Cyan Toner 8 | Resin B | Wax (F) | P.B. 15 | Sali.Al comp. | $SiO_2$ | Air | App. A |
| 14 Cyan Toner 9 | Resin C | Wax (G) | P.B. 15 | Sali.Al comp. | $SiO_2$ | Air | Elbow J./ thermospherical |
| 15 Cyan Toner 10 | Resin C | Wax (G) | P.B. 15 | Sali.Al comp. | $SiO_2$ | Air | App. A |

Sali.Al comp.: Salicylic acid aluminum compound

TABLE 3(B)

| Toner No. | Average circularity | X (% by number) | Y (% by number) | 0.6~<3.0 μm cont. A (% by number) | 0.6~<2.0 μm cont. B (% by number) | 2.0~<3.0 μm cont. C (% by number) | B/C | Average surface roughness (nm) | DSC (° C.) | Transmittance (%) |
|---|---|---|---|---|---|---|---|---|---|---|
| | | Toner physical properties | | | | | | | | |
| 1 | 0.935 | 24.8 | 20.4 | 6.5 | 4.3 | 2.2 | 2.0 | 22.5 | 77.2 | 45 |
| 2 | 0.925 | 20.4 | 22.2 | 8.8 | 6.0 | 2.8 | 2.1 | 24.5 | 89.2 | 38 |
| 3 | 0.940 | 34.2 | 13.5 | 11.9 | 9.6 | 2.3 | 4.2 | 15.2 | 71.6 | 52 |
| 4 | 0.937 | 25.3 | 19.5 | 4.2 | 2.2 | 2.0 | 1.1 | 22.0 | 76.5 | 42 |
| 5 | 0.935 | 26.6 | 18.4 | 5.5 | 3.5 | 2.0 | 1.8 | 25.1 | 77.0 | 48 |
| 6 | 0.922 | 15.0 | 27.3 | 14.8 | 11.7 | 3.1 | 3.8 | 29.1 | 71.7 | 34 |
| 7 | 0.922 | 14.2 | 28.0 | 12.2 | 7.3 | 4.9 | 1.5 | 28.8 | 66.4 | 38 |
| 8 | 0.947 | 36.8 | 10.6 | 8.3 | 5.8 | 2.5 | 2.3 | 11.0 | 104.9 | 61 |
| 9 | 0.923 | 13.6 | 27.5 | 9.8 | 4.7 | 5.1 | 0.9 | 25.2 | 67.1 | 30 |
| 10 | 0.922 | 14.0 | 28.0 | 10.4 | 7.9 | 2.5 | 3.2 | 30.2 | 105.2 | 40 |
| 11 | 0.948 | 38.8 | 9.5 | 13.4 | 10.1 | 3.3 | 3.1 | 9.8 | 66.9 | 72 |
| 12 | 0.915 | 9.8 | 48.5 | 15.3 | 11.8 | 3.5 | 3.4 | 35.7 | 67.2 | 18 |
| 13 | 0.921 | 28.8 | 32.2 | 8.4 | 4.0 | 4.4 | 0.9 | 34.2 | 113.3 | 31 |
| 14 | 0.975 | 80.0 | 4.5 | 15.5 | 12.5 | 3.0 | 4.2 | 5.9 | 61.2 | 81 |
| 15 | 0.951 | 41.1 | 9.8 | 6.5 | 5.4 | 1.1 | 4.9 | 20.2 | 62.3 | 58 |

X: Number frequency cumulative value (% by number) of particles having circularity of 0.960 or more in particles having circle-equivalent diameter of 3.00 μm or more
Y: Number frequency cumulative value (% by number) of particles having circularity of 0.920 or less in particles having circle-equivalent diameter of 3.00 μm or more
DSC: Endothermic peak temperature (° C.) of toner

TABLE 4

| | Toner and developer No. | Transfer efficiency: Initial stage | Transfer efficiency: After 50k | Transfer efficiency: Evaluation | Charge stability: Initial stage | Charge stability: After 50k | Charge stability: Δ | Charge stability: Evaluation | Carrier spent: Δ | Carrier spent: Evaluation | Fixing performance: (1) | Fixing performance: (2) | Fixing performance: Fixable range | Fixing performance: Evaluation |
|---|---|---|---|---|---|---|---|---|---|---|---|---|---|---|
| Example: | | | | | | | | | | | | | | |
| 1 | Cyan 1 | 97 | 94 | A | 29.8 | 28.2 | 1.6 | A | 4.0 | A | A | A | 140~200 | A |
| 2 | Cyan 2 | 95 | 93 | A | 28.3 | 28.0 | 0.3 | A | 4.2 | A | A | A | 150~190 | B |
| 3 | Cyan 3 | 98 | 95 | A | 28.8 | 25.7 | 3.1 | B | 10.8 | B | A | C | 140~190 | A |
| 4 | Magenta 1 | 97 | 94 | A | 29.0 | 28.0 | 1.0 | A | 3.8 | A | A | A | 140~200 | A |
| 5 | Yellow 1 | 98 | 94 | A | 28.5 | 25.9 | 2.6 | A | 3.6 | A | A | B | 140~200 | A |
| 6 | Black 1 | 96 | 93 | A | 30.1 | 23.7 | 6.4 | C | 15.2 | C | A | B | 140~190 | A |
| 7 | Magenta 2 | 95 | 88 | B | 32.9 | 23.8 | 9.1 | C | 12.2 | C | C | A | 140~170 | C |
| 8 | Yellow 2 | 96 | 88 | B | 26.5 | 24.2 | 2.3 | A | 5.7 | A | A | C | 140~180 | B |
| 9 | Cyan 4 | 91 | 84 | C | 30.5 | 22.2 | 8.3 | C | 6.9 | A | B | A | 150~180 | C |
| 10 | Cyan 5 | 92 | 80 | C | 35.3 | 26.2 | 9.1 | C | 6.0 | A | A | B | 130~160 | C |
| 11 | Cyan 6 | 96 | 89 | B | 34.5 | 27.0 | 7.5 | C | 13.0 | C | C | C | 150~180 | C |
| Comparative Example: | | | | | | | | | | | | | | |
| 1 | Cyan 7 | 91 | 75 | D | 31.0 | 20.1 | 10.9 | D | 23.0 | E | C | D | 150~180 | C |
| 2 | Cyan 8 | 94 | 79 | D | 31.3 | 12.8 | 18.5 | E | 17.5 | D | C | C | 130~140 | D |
| 3 | Cyan 9 | 98 | 86 | C | 30.1 | 12.2 | 17.9 | E | 21.8 | E | D | D | 160~170 | D |
| 4 | Cyan 10 | 96 | 78 | D | 32.2 | 13.1 | 19.1 | E | 18.1 | D | D | D | 160~170 | D |

(1) Anti-blocking properties;
(2) Cleaning performance

This application claims priority from Japanese Patent Application No. 2003-321743 filed Sep. 12, 2003, and No. 2003-321741 filed Sep. 12, 2003, which are hereby incorporated by reference herein.

What is claimed is:

1. A color toner comprising toner particles which comprise toner base particles containing at least a binder resin, a colorant and a wax, and inorganic fine particles, wherein;

(i) in said toner base particles, particles having a circle-equivalent diameter of 3.00 μm or more as measured with a flow type particle image analyzer have an average circularity of from 0.920 or more to less than 0.950;

(ii) in the particles having a circle-equivalent diameter of 3.00 μm or more in said toner base particles, particles having a circularity of 0.960 or more are in a number frequency cumulative value of 40% or less; and (iii) in the particles having a circle-equivalent diameter of 3.00 μm or more in said toner base particles, particles having a circularity of 0.920 or less are in a number frequency cumulative value of 30% or less.

2. The color toner according to claim 1, wherein, in said toner base particles, particles having a circle-equivalent diameter of from 0.60 μm or more to less than 3.00 μm are present in a content A (% by number) which satisfies $0.1 \leqq A < 15.0$ with respect to all toner base particles.

3. The color toner according to claim 1, wherein, in said toner base particles, particles having a circle-equivalent diameter of from 0.60 μm or more to less than 2.00 μm are present in a content B (% by number) and particles having a circle-equivalent diameter of from 2.00 μm or more to less than 3.00 μm are present in a content C (% by number) which B and C satisfy $0.5<B/C<15.0$ with respect to all toner base particles.

4. The color toner according to claim 1, wherein said toner base particles have an average surface roughness of from 5.0 nm or more to less than 35.0 nm as measured with a scanning probe microscope.

5. The color toner according to claim 1, which has, in the endothermic curve measured by differential thermal analysis, one, or a plurality of, endothermic peak(s) in the range of from 30° C. to 200° C. and a maximum peak temperature of the endothermic peak(s) in the range of from 60° C. to 110° C.

6. The color toner according to claim 1, wherein said binder resin has at least a polyester unit.

7. The color toner according to claim 1, wherein said binder resin is a resin selected from the group consisting of (a) a polyester resin, (b) a hybrid resin having a polyester unit and a vinyl polymer unit, (c) a mixture of the hybrid resin and a vinyl polymer, (d) a mixture of a polyester resin and a vinyl polymer, (e) a mixture of the hybrid resin and a polyester resin and (f) a mixture of the hybrid resin, a polyester resin and a vinyl polymer.

8. The color toner according to claim 1, wherein said wax is a hydrocarbon wax.

9. The color toner according to claim 1, wherein said inorganic fine particles comprise at least titanium oxide.

10. The color toner according to claim 1, which has a light transmittance (%) in the range of from 10% to 80% which is of the light of 600 nm in wavelength with respect to a liquid dispersion prepared by dispersing said toner in an aqueous solution of 45% by volume of methanol.

11. The color toner according to claim 1, which is a non-magnetic toner.

12. The color toner according to claim 1, wherein said toner base particles are toner base particles obtained through at least:

a kneading step of melt-kneading a mixture containing the binder resin and the colorant, to obtain a kneaded product;

a cooling step of cooling the kneaded product obtained;

a crushing step of crushing the kneaded product cooled, to obtain a crushed product;

a pulverization step of finely pulverizing the resultant crushed product by the use of an air pulverizing means to form a finely pulverized product;

a classification step of classifying the resultant finely pulverized product by the use of a multi-division classifying means that utilizes the Coanda effect, to obtain a median powder; and a surface modification step of subjecting the resultant median powder to surface modification of particles by the use of a surface modifying apparatus.

13. A full-color image forming method which forms an image by the use of at least a magenta toner, a yellow toner, a cyan toner and a black toner;

said toners each being a color toner comprising toner particles which comprise toner base particles containing at least a binder resin, a colorant and a wax, and inorganic fine particles, wherein;

(i) in said toner base particles, particles having a circle-equivalent diameter of 3.00 μm or more as measured with a flow type particle image analyzer have an average circularity of from 0.920 or more to less than 0.950;

(ii) in the particles having a circle-equivalent diameter of 3.00 μm or more in said toner base particles, particles having a circularity of 0.960 or more are in a number frequency cumulative value of 40% or less; and (iii) in the particles having a circle-equivalent diameter of 3.00 μm or more in said toner base particles, particles having a circularity of 0.920 or less are in a number frequency cumulative value of 30% or less.

* * * * *